US006354907B1

(12) United States Patent
Satoh et al.

(10) Patent No.: US 6,354,907 B1
(45) Date of Patent: Mar. 12, 2002

(54) POLISHING APPARATUS INCLUDING ATTITUDE CONTROLLER FOR TURNTABLE AND/OR WAFER CARRIER

(75) Inventors: Ichiju Satoh; Norio Kimura; Katsuya Okumura, all of Kanagawa-ken (JP)

(73) Assignees: Ebara Corporation, Tokyo; Kabushiki Kaisha Toshiba, Kanagawa-ken, both of (JP)

( * ) Notice: Subject to any disclaimer, the term of this patent is extended or adjusted under 35 U.S.C. 154(b) by 0 days.

(21) Appl. No.: 09/522,705

(22) Filed: Mar. 10, 2000

(30) Foreign Application Priority Data

Mar. 11, 1999 (JP) ..... 11-65708
Mar. 11, 1999 (JP) ..... 11-65709

(51) Int. Cl.[7] ..... B24B 49/00

(52) U.S. Cl. ..... 451/5; 451/9; 451/10; 451/41; 451/63; 451/287; 451/288

(58) Field of Search ..... 451/5, 9, 10, 41, 451/63, 287, 288

(56) References Cited

U.S. PATENT DOCUMENTS 5,951,368 A * 9/1999 Watanabe et al. ..... 451/5
6,019,868 A * 2/2000 Kimura et al. ..... 156/345
6,220,945 B1 * 4/2001 Hirokawa et al. ..... 451/287

* cited by examiner

*Primary Examiner*—Derris H. Banks
*Assistant Examiner*—Shantese McDonald
(74) *Attorney, Agent, or Firm*—Wenderoth, Lind & Ponack, L.L.P.

(57) ABSTRACT

There is provided a polishing apparatus comprising an attitude controller for controlling an attitude or orientation of a turntable having a polishing surface and/or a carrier for holding an article to be polished in a sliding contact relation with the polishing surface. The turntable and carrier are connected to their drive shafts through universal joints. The attitude controllers control angles of tilting of the turntable and the carrier relative to their drive shafts.

26 Claims, 22 Drawing Sheets

POLISHING APPARATUS INCLUDING ATTITUDE CONTROLLER FOR TURNTABLE AND/OR WAFER CARRIER

BACKGROUND OF THE INVENTION

The present invention relates to a polishing apparatus for polishing an article such as a semiconductor wafer, and in particular, relates to a polishing apparatus provided with an attitude controller for controlling an attitude of a turntable which is provided with a polishing surface and/or a carrier for carrying an article to be polished and bringing it into contact with the polishing surface of the turntable.

With recent rapid progress in technology for fabricating high-integration semiconductor devices, circuit wiring patterns have been becoming increasingly fine, with spaces between wiring patterns also decreasing. As wiring spacing decreases to less than 0.5 microns, the depth of focus in circuit pattern formation in photolithography and the like becomes shallower. Accordingly, surfaces of semiconductor wafers on which circuit pattern images are to be formed by a stepper are required to be polished by a polishing apparatus to an exceptionally high degree of surface flatness or planarization. As one method for effecting such planarization, for example, a chemical/mechanical polisher (CMP) has recently been used, in which polishing is carried out while a polishing solution having a predetermined chemical composition is supplied.

FIG. 26 shows such a conventional polisher for polishing a semiconductor wafer. The polisher includes a turntable 52 provided on its upper surface with a polishing cloth 51 and a wafer carrier 54 for holding a semiconductor wafer 53. In a polishing operation, the turntable and the wafer carrier are independently rotated about their axes by motors (not shown) while the wafer 53 is engaged with the polishing cloth 51 and an abrasive liquid Q is supplied through a nozzle 57 provided above the turntable. However, during polishing, if the polishing cloth 51 does not engage with the wafer 53 under a uniform pressure across respective engaging surfaces, the wafer fails to be polished evenly. To solve this problem, the conventional polishing apparatus is provided with a universal joint comprising a ball bearing 56 between the wafer carrier 54 and a drive shaft 55 for pressing the wafer 53 against the polishing cloth 51 while drivingly rotating the wafer carrier 54. The universal joint enables the wafer 54 to tilt about the ball bearing 56 in response to inclinations in the polishing surface of the polishing cloth 51. Consequently, the polishing surface of the polishing cloth 51 and the polished surface of the wafer 53 held by the wafer carrier 54 are kept in a parallel relation with each other, whereby pressure between the wafer and the polishing cloth is kept even across the entire surface of the water. Japanese Patent Application 06198561 A discloses such a universal joint.

However, as stated above, since the drive shaft presses the wafer 53 against the polishing cloth 51 under a pressure F, a friction force $\mu F$, in which $\mu$ is a friction coefficient, is generated and this causes a rotational moment $M=\mu FH$, in which H is a height of the center of the ball bearing 56 relative to the upper surface of the polishing cloth 51. The wafer 53 is thus inclined downward in a direction opposite to the direction D in which the polishing cloth 51 on the turntable 52 passes under the wafer 53, with the result that the wafer 53 is subject to an uneven pressure imposed by the polishing cloth 51. To make the rotational moment M zero, it is necessary to make the above-noted height H zero. There is proposed an apparatus in which the center of tilting is positioned at a level of engagement between a wafer and a polishing cloth.

In theory, if the center of tilting lies on a surface where the polishing cloth and the wafer engage with each other, the rotational moment M which tends to tilt the wafer carrier will become zero and thus the wafer carrier can be kept parallel to the turntable. However, in practice, the polishing surface or upper surface of the polishing cloth on the turntable is not exactly even across its entire area which gives rise to a change in inclination of the polishing surface which is in contact with the wafer when the turntable is rotated. As a consequence of such a change in inclination of the polishing surface, the wafer carrier tends to tilt excessively under its inertia moment resulting in unstable tilting. Consequently, the wafer is unable to be engaged with the polishing cloth under a uniform pressure.

JP 1058308A discloses a polishing apparatus which is provided with an electromagnetic bearing including an electromagnetic thrust bearing device and an electromagnetic radial bearing device for bearing a drive shaft of a wafer carrier with an electromagnetic force, and an attitude controller for controlling the attitude of the drive shaft to keep the wafer carrier parallel to a turntable.

However, since in the polishing apparatus in accordance with JP 1058308A, the drive shaft of the wafer carrier is designed to be supported only by the electromagnetic bearing under the influence of the electromagnetic force generated thereby, it involves the following problems:

1) It is necessary for the thrust bearing device to be capable of generating a large magnetic force to press a wafer against the polishing cloth.
2) In terms of design, a motor for actuating the wafer carrier is required to be accommodated in a housing which also houses the electromagnetic bearing, and thus the size of the housing becomes large.
3) The wafer carrier is required to be movable up and down so as to load and unload a semiconductor wafer. This means that the wafer carrier, the electromagnetic bearing and the motor noted above are required to be moved as a unit and thus a mechanism for moving the unit also becomes large.

The present invention aims to solve the problems 1)–3) outlined above and, specifically, to provide a polishing apparatus which includes an attitude controller for controlling an attitude of a wafer carrier and/or a turntable so that the wafer or an object to be polished can be engaged with a polishing cloth on a turntable with a uniform pressure being exerted across its entire area.

SUMMARY OF THE INVENTION

In view of the above-described circumstances, an object of the present invention is to provide a polishing apparatus with an attitude controller for controlling an attitude of a turntable and/or a carrier for carrying an article to be polished, whereby the article is engaged with a polishing surface on the turntable under a uniform pressure thereby being polished to a very high degree of flatness.

In accordance with one aspect of this invention, there is provided a polishing apparatus comprising a turntable having a polishing surface that comes into sliding contact with an object to be polished, a support for tiltably supporting the turntable, and, an attitude controller for controlling an attitude or orientation of the turntable. The attitude controller may control the attitude of the turntable by controlling an angle of tilting of the turntable relative to the support by virtue of an electromagnetic force. The polishing apparatus may include a stationary frame, and the attitude controller may comprise an electromagnetic device fixedly provided on the stationary frame of the polishing apparatus, and an armature fixedly provided on the turntable and adapted to be moved by virtue of an electromagnetic force generated by the electromagnetic device. The attitude controller may comprise a cylinder device provided under the turntable and fixed to a stationary frame of the polishing apparatus and engaged with a lower surface of the turntable so that the cylinder device controls the attitude of the turntable by extension and retraction thereof.

In accordance with another aspect of the present invention, there is provided a polishing apparatus comprising a turntable having a polishing surface, a carrier for holding an article to be polished in a sliding contact relation with the polishing surface, a pressing device connected to the carrier and adapted to press the carrier towards the turntable with the article engaged with the polishing surface, and an attitude controller for controlling an attitude or orientation of the carrier. The pressing device may be a drive shaft for drivingly rotating the wafer carrier and the polishing apparatus includes a universal joint connecting the drive shaft and the carrier in such a manner that the carrier can tilt relative to the drive shaft. The attitude controller may comprise an electromagnetic device fixedly provided on a frame for rotatably supporting the drive shaft and an armature fixedly provided on the carrier and adapted to be moved by virtue of an electromagnetic force generated by the electromagnetic device. The attitude controller includes a sensor for sensing the attitude or orientation of the carrier so that the attitude controller controls the attitude of the wafer in response to the sensed attitude or orientation. The polishing apparatus may further include a pressing member provided radially outside the carrier and movable up and down independently of the carrier, an urging device for urging the pressing member, and a bearing for supporting the pressing member on the carrier in such a manner that the pressing member is kept stationary while allowing the carrier to rotate. The carrier may include a mounting member connected to the pressing device and an article holding member with a gap interposed therebetween, and the article holding member has a lower surface for holding an article to be polished and is flexible so that it can be deformed in both a concave and convex manner in a vertical direction by controlling a pressure in the gap. The carrier may include a retainer ring provided on the outer periphery of the carrier to confine the article held on the lower surface of the holding member. The retainer ring is movable vertically relative to the holding member, and the carrier further includes a pressing device for pressing the retainer ring vertically against the polishing surface of the turntable.

In accordance with yet another aspect of this invention, there is provided a polishing apparatus including both the turntable attitude controller and the carrier attitude controller as noted above.

The above and other objects, features and advantages of the present invention will become more apparent from the following description of the preferred embodiments thereof, taken in conjunction with the accompanying drawings.

DETAILED DESCRIPTION OF THE INVENTION

Embodiments of the polishing apparatus according to the present invention will be described below in detail with reference to FIGS. 1 to 25.

Figure 1:
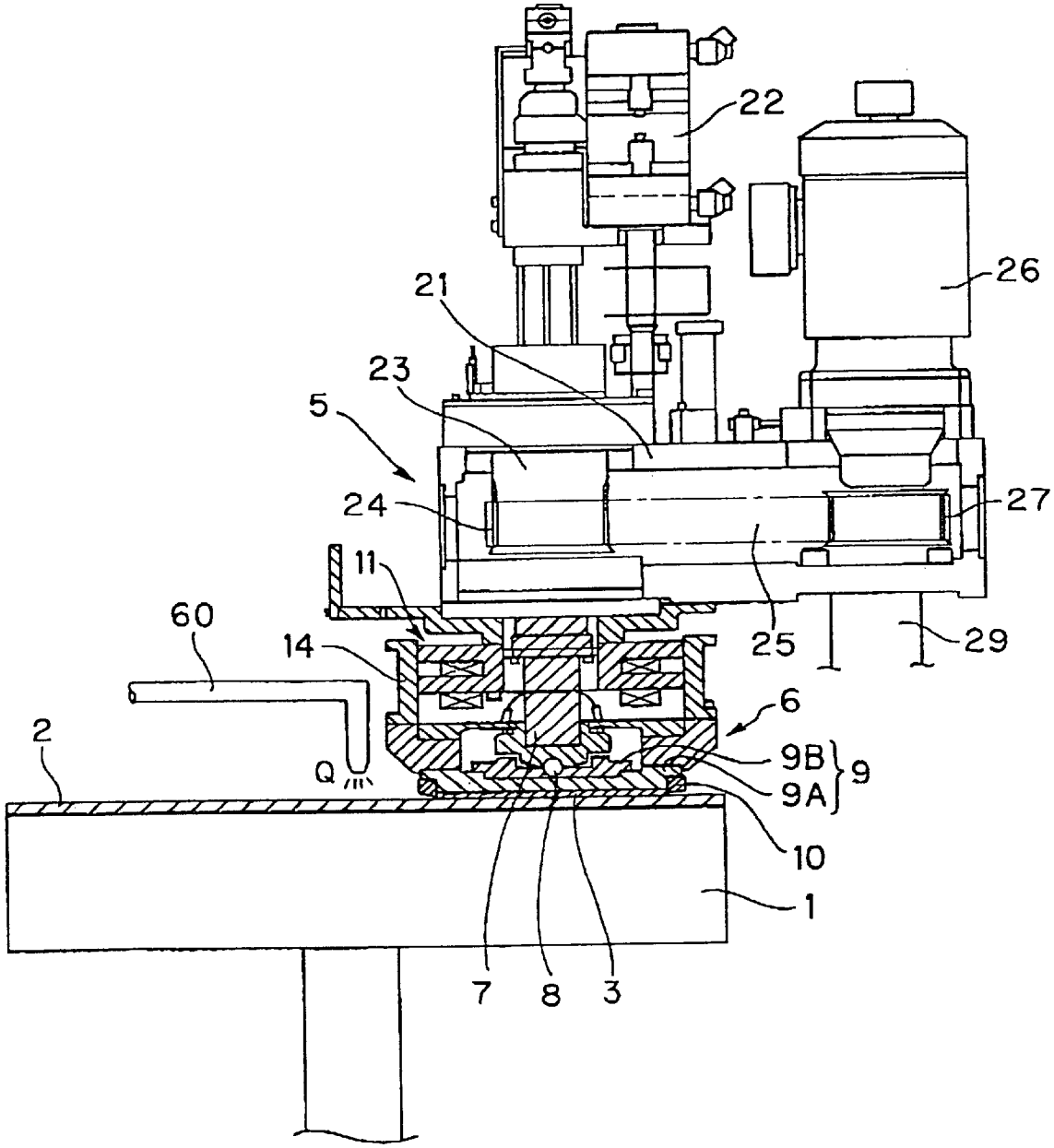
FIG. 1 is a vertical sectional view showing the general arrangement of a first embodiment of the polishing apparatus according to the present invention.
Figure 2:
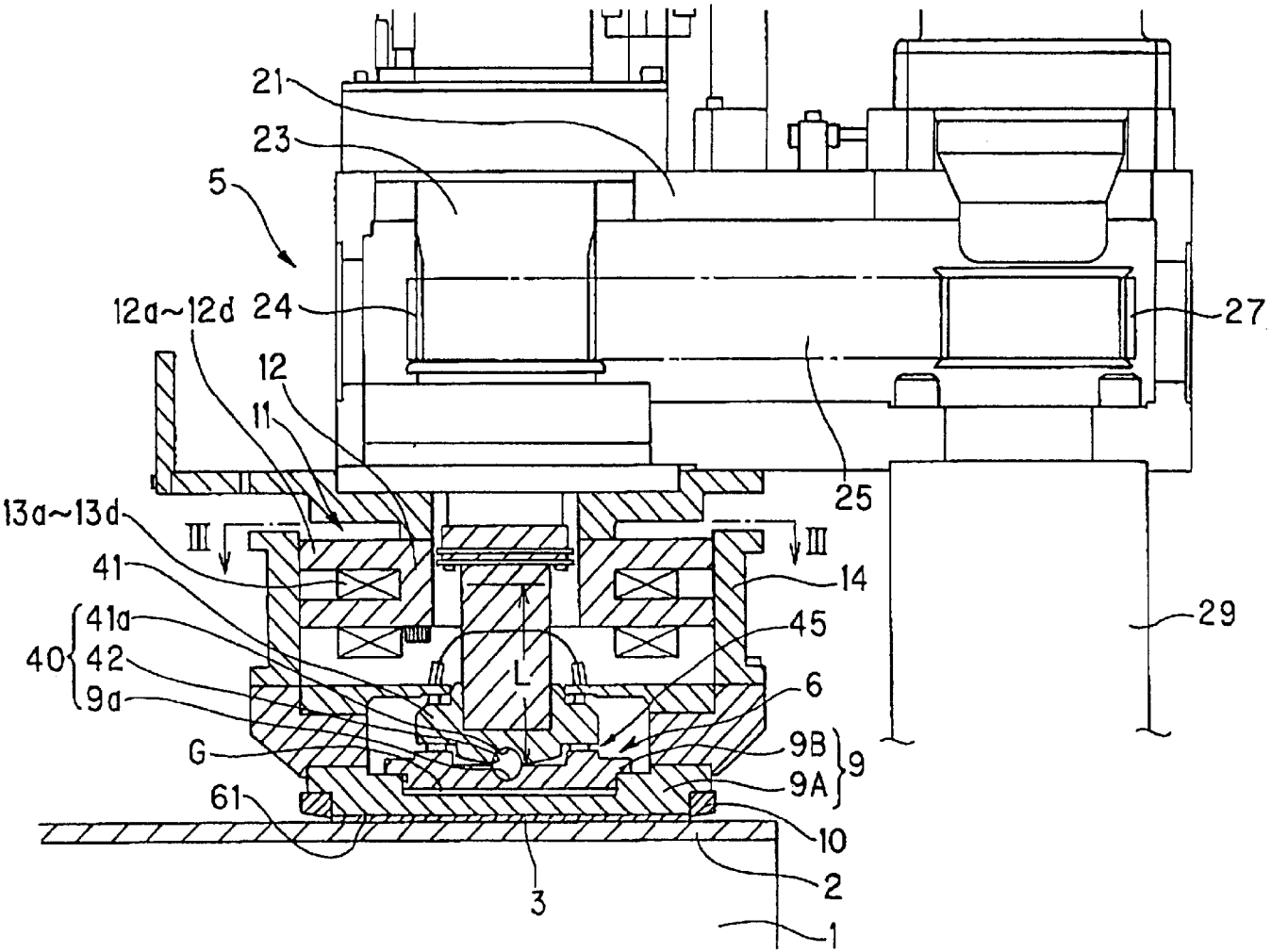
FIG. 2 is a fragmentary sectional view showing an essential part of the polishing apparatus according to the first embodiment.

FIG. 1 is a vertical sectional view showing the general arrangement of a first embodiment of the polishing apparatus according to the present invention, and FIG. 2 is a fragmentary sectional view showing an essential part of the polishing apparatus.

As shown in FIGS. 1 and 2, the polishing apparatus includes a turntable 1 having a polishing cloth 2 bonded to the upper surface thereof, and a carrier apparatus 5. The carrier apparatus 5 includes a wafer carrier 6 for holding a semiconductor wafer 3, and a drive shaft 7 for supporting the wafer carrier 6 and applying a pressing force and rotational driving force to the wafer carrier 6. The carrier apparatus 5 further includes a universal coupling 8 for transmitting a pressing force from the drive shaft 7 to the wafer carrier 6 while allowing the wafer carrier to tilt relative to the drive shaft 7, and an attitude or orientation controller 11 for controlling the attitude of the wafer carrier 6. An abrasive liquid supply nozzle 60 is provided above the turntable 1 to supply an abrasive liquid onto the polishing cloth 2 on the turntable 1. The upper surface of the polishing cloth 2 constitutes a polishing surface that comes into contact with a surface of a semiconductor wafer to be polished.

As shown in FIG. 2, the wafer carrier 6 includes a carrier body 9 comprising a wafer holding plate 9A and a mounting plate 9B and a retainer ring 10 fixed to the outer periphery of the carrier body 9. The wafer carrier 6 is adapted to hold a semiconductor wafer 3 on the lower surface of the holding plate 9A in such a manner that the wafer 3 is prevented from being displaced from the lower surface of the holding plate 9A by the retaining ring 10. The holding plate 9A is fixedly provided on its lower surface with a resilient mat 61.

Further, as shown in FIG. 2, there is provided a gap G between the holding plate 9A and the mounting plate 9B which is adapted to be subject to a fluid pressure including a vacuum. The holding plate 9A includes a plurality of through holes (not shown) connecting the gap G to the lower surface thereof. The resilient mat also includes a plurality of through holes (not shown) corresponding to the through holes of the holding plate 9A. This enables the fluid pressure to be applied to the upper surface of a wafer on the lower surface of the resilient mat 61.

As shown in FIG. 1, the carrier drive shaft 7 is coupled to a carrier air cylinder 22 secured to a carrier head 21. The carrier air cylinder 22 vertically moves the carrier drive shaft 7 thereby enabling the wafer 3 held by the carrier to be pressed against the turntable 1.

The carrier drive shaft 7 is coupled to a rotating cylinder 23 through a key (not shown). The rotating cylinder 23 has a timing pulley 24 on an outer peripheral portion thereof. The timing pulley 24 is connected through a timing belt 25 to a timing pulley 27 provided on a carrier motor 26 secured to the carrier head 21. Accordingly, the carrier motor 26 drivingly rotates the rotating cylinder 23 and the carrier drive shaft 7 through the timing pulley 27, the timing belt 25 and the timing pulley 24, thereby drivingly rotating the carrier 6. The carrier head 21 is supported by a carrier head shaft 29 fixedly supported on a frame.

The universal coupling 8, which transmits a pressing force from the carrier drive shaft 7 to the carrier 6 while allowing these members to tilt relative to each other, has a spherical bearing mechanism 40 that allows the carrier 6 and the carrier drive shaft 7 to tilt relative to each other. The universal coupling 8 further has a rotation transmitting mechanism 45 for transmitting the rotation of the carrier drive shaft 7 to the carrier body 9. The spherical bearing mechanism 40 includes a spherical recess 41*a* formed in the center of the lower surface of a driving flange 41 secured to the lower end of the carrier drive shaft 7. The spherical bearing mechanism 40 further includes a spherical recess 9*a* formed in the center of the upper surface of the mounting plate 9B, and a ball bearing 42 interposed between the two recesses 41*a* and 9*a*. The ball bearing 42 is made of a material of high hardness, such as a ceramic.

The rotation transmitting mechanism 45 includes a driving pin (not shown) secured to the driving flange 41 and a driven pin (not shown) secured to the mounting plate 9B. The driven pin and the driving pin are vertically movable relative to each other. Therefore, even when the carrier body 9 tilts, the driven pin and the driving pin are kept in engagement with each other, with a point of contact shifting between them. Thus, the rotation transmitting mechanism 45 transmits the rotational torque of the carrier driving shaft 7 to the carrier body 9 in a reliable and stable fashion.

Figure 3:
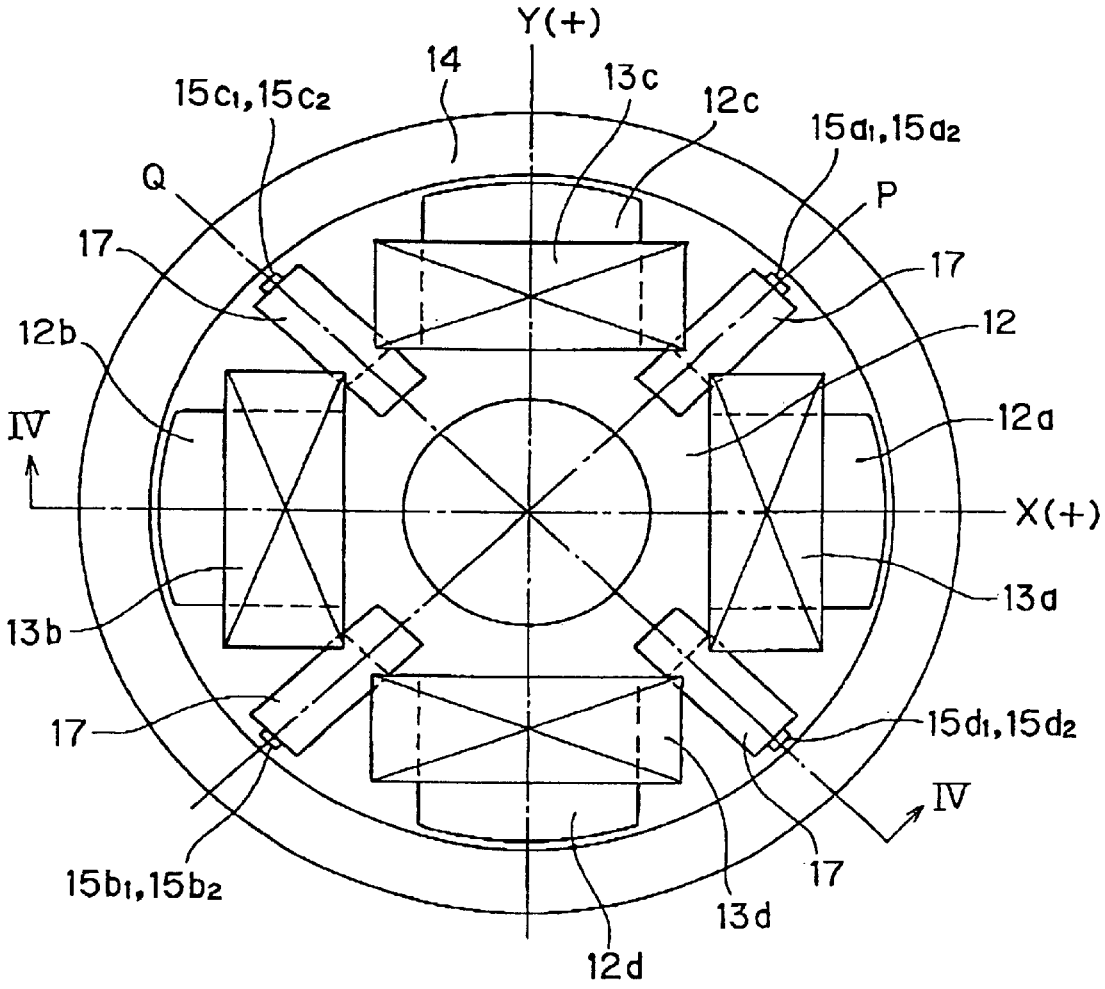
FIG. 3 is a sectional view taken along the line III—III in FIG. 2.

Next, the attitude controller 11 for controlling the attitude or orientation of the carrier 6 will be described with reference to FIGS. 2 to 6. FIG. 2 is a fragmentary sectional view showing an essential part of the polishing apparatus, as stated above. FIG. 3 is a view as seen from the arrow III—III in FIG. 2, and FIG. 4 is a sectional view taken along the line IV—IV in FIG. 3.

As shown in FIGS. 2 and 3, the attitude controller 11 includes an electromagnetic core 12 secured to the carrier head 21. Four magnetic poles 12*a*, 12*b*, 12*c* and 12*d* project radially outward from the electromagnetic core 12. Four electromagnetic coils 13*a*, 13*b*, 13*c* and 13*d* are wound on the magnetic poles 12*a* to 12*d*, respectively. The attitude controller 11 further includes a cylindrical armature 14 facing the magnetic poles 12*a* to 12*d* across a gap. The armature 14 is secured to the carrier body 9.

Figure 4:
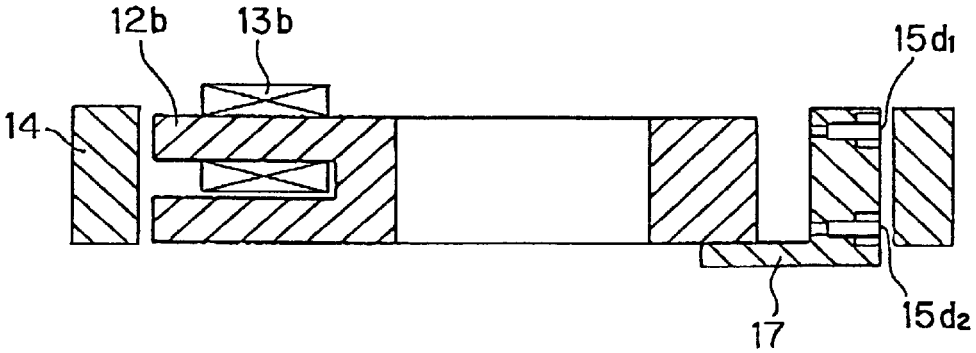
FIG. 4 is a sectional view taken along the line IV—IV in FIG. 3.

According to FIG. 4, the magnetic poles 12*a* to 12*d* (only magnetic pole 12*b* is illustrated) each have a U-shaped sectional configuration having a 90-degree rotation. The upper horizontally projecting portions of the magnetic poles 12*a* to 12*d* are wound with the electromagnetic coils 13*a* to 13*d*, respectively. The magnetic poles 12*a* to 12*d* and the armature 14 are formed from a magnetic material, e.g. a permalloy. As shown in FIG. 3, the electromagnetic coil 13*a* is placed at a position in positive alignment with the X- axis. The electromagnetic coil 13*b* is placed at a position in negative alignment with the X-axis. The electromagnetic coil 13*c* is placed at a position in negative alignment with the Y-axis. The electromagnetic coil 13*d* is placed at a position in negative alignment with the Y-axis. Four pairs of displacement sensors $\mathbf{15}a_1$, $\mathbf{15}a_2$; $\mathbf{15}b_1$, $\mathbf{15}b_2$; $\mathbf{15}c_1$, $\mathbf{15}c_2$; and $\mathbf{15}d_1$, $\mathbf{15}d_2$ are placed on two axes P and Q tilted at an angle of 45 degrees with respect to the X- and Y-axes. Each pair of displacement sensors consists of upper and lower displacement sensors. Each displacement sensor pair is held by a sensor holder 17.

Figure 5:
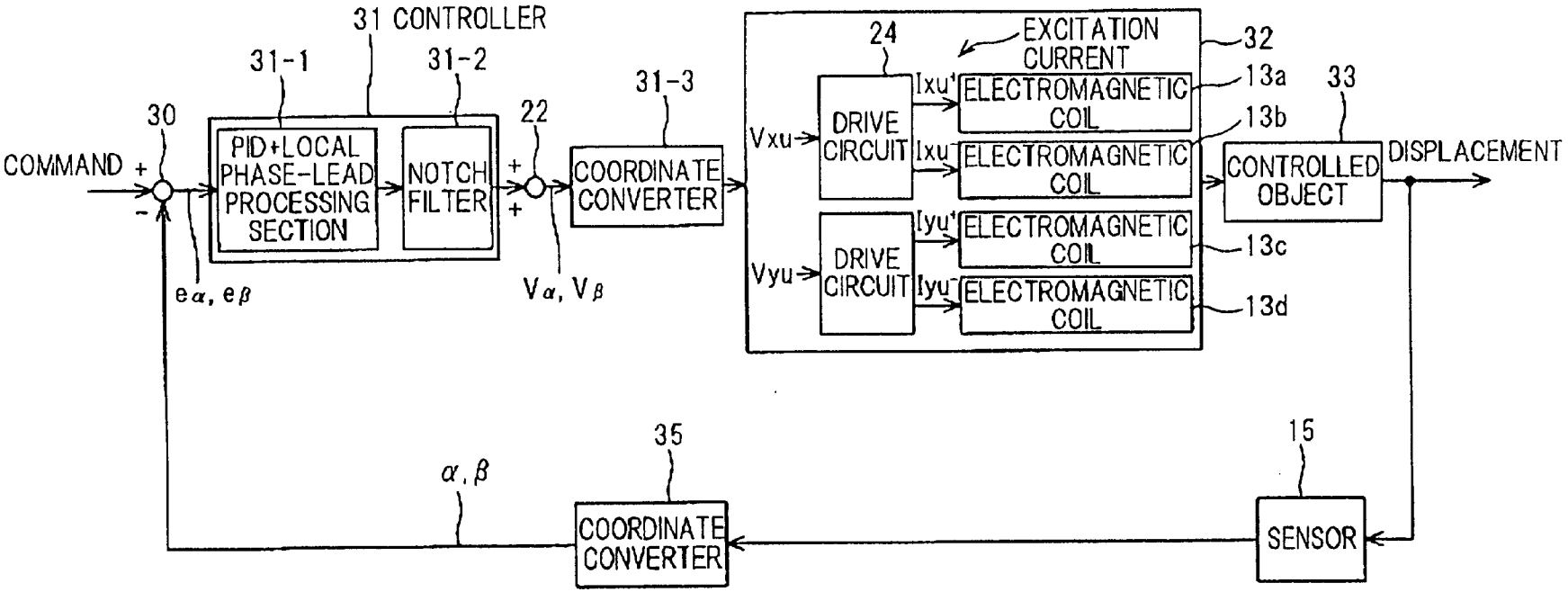
FIG. 5 is a block diagram showing the functional arrangement of a control part for controlling an attitude controller for a carrier.
Figure 6:
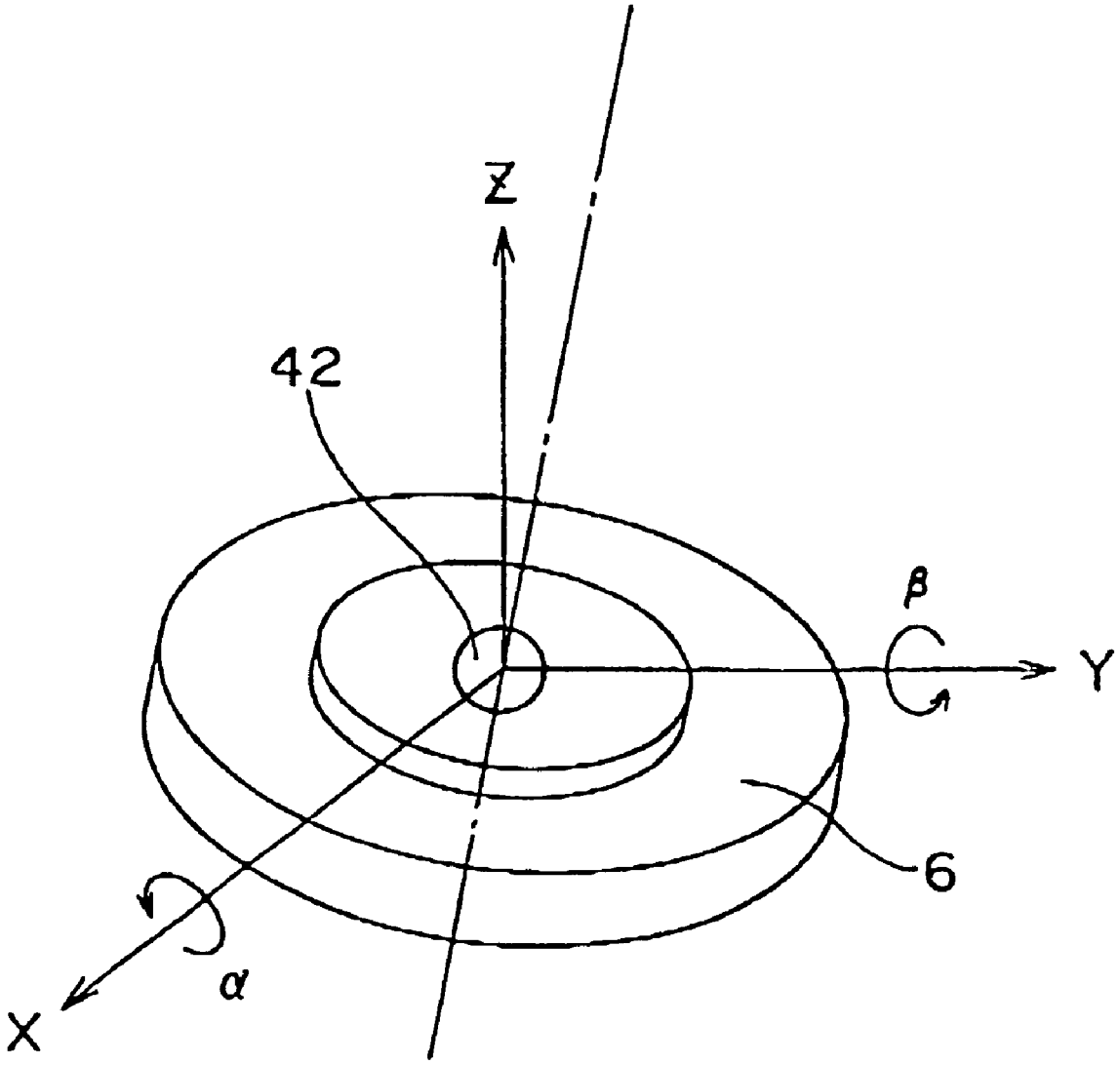
FIG. 6 is a diagram illustrating the relationship between the tilt $\alpha$ of the carrier with respect to an X-axis and the tilt $\beta$ of the carrier with respect to a Y-axis.

FIG. 5 is a block diagram showing the functional arrangement of a control part for controlling the attitude controller 11. As shown in the figure, the control part has a subtracter 30 and a controller 31. The subtracter 30 is supplied with desired values for the attitude of the carrier 6, and values $\alpha$ and $\beta$ of displacement of a controlled system (carrier 6) that are detected by sensors 15 (displacement sensors $\mathbf{15}a_1$. $\mathbf{15}a_2$; $\mathbf{15}b_1$, $\mathbf{15}b_2$; $\mathbf{15}c_1$, $\mathbf{15}c_2$; and $\mathbf{15}d_1$, $\mathbf{15}d_2$) and converted in a coordinate converter 35. Differences between the desired values and the displacement values a $\alpha$ and $\beta$ derived from the subtracter 30 are input to the controller 31 as error signals $e\alpha$ and $e\beta$. As shown in FIG. 6, $\alpha$ and $\beta$ indicate a tilt with respect to an X-axis and a tilt with respect to a Y-axis, respectively. The X-axis and the Y-axis lie along a horizontal plane. In this case, the carrier 6 performs a combined motion consisting of tilting with respect to the X-axis and tilting with respect to the Y-axis about the bearing ball 42 acting as the center of rotation.

The error signals $e\alpha$ and $e\beta$ are subjected to a tilt control and attenuation processing in a PID+local phase-lead processing section 31-1 and are further passed through a notch filter 31-2 to remove vibrational components, and converted into voltage command signals $V\alpha$ and $V\beta$. Then, in a coordinate converter 31-3, the voltage command signals $V\alpha$ and $V\beta$ are converted into control signals $V_{xu}$ and $V_{yu}$ output by the attitude controller for supply to a driver section 32.

The driver section 32 includes the electromagnetic coils 13*a*, 13*b*, 13*c* and 13*d* and drive circuits 24 for exciting these coils. The control signals $V_{xu}$ and $V_{yu}$ are supplied to the respective drive circuits 24, in which they are converted into excitation currents $I_{xu}+$, $I_{xu}-$, $I_{yu}+$ and $I_{yu}-$ for displacing the armature 14 in any of the positive and negative directions of the X- and Y-axes shown in FIG. 3. The excitation currents $I_{xu}+$, $I_{xu}-$, $I_{yu}-$ and $I_{yu}$— are supplied to the electromagnetic coils 13*a*, 13*b*, 13*c* and 13*d* to control the attitude of the controlled system (carrier 6). In this case, the center of rotation (bearing ball 42) of the carrier 6 and the X- and Y-axes of the armature 14 shown in FIG. 3 are apart from each other by a predetermined height (L). Therefore, when the armature 14 is displaced in the positive or negative direction of the X- or Y-axis shown in FIG. 3, the carrier body 9, that is, the carrier 6, can be tilted in the desired direction with respect to the horizontal plane about the bearing ball 42 as the center of rotation.

In a polishing operation, the semiconductor wafer 3 carried by the wafer carrier 6 is pressed by the air cylinder 22 against the polishing cloth 2 which is being rotated by the motor, while an abrasive liquid Q is supplied onto the polishing cloth 2. The force for pressing the wafer 3 is transferred through the drive shaft 7 and the universal coupling 8 to the wafer carrier body 9 holding the wafer 3. The abrasive liquid Q supplied from the nozzle 60 flows between the wafer 3 and the polishing cloth 2 to facilitate polishing of the wafer.

During the polishing operation, the attitude of the carrier body 9 is controlled by the attitude controller 11. In this case, as has been stated above, the tilt of the carrier body 9 is detected by processing the outputs of the displacement sensors 15 (15*a*,$_1$, 15*a*$_2$; 15*b*$_1$, 15*b*$_2$; 15*c*$_1$, 15*c*$_2$; and 15*d*$_1$, 15*d*$_2$) so that the carrier body 9 is controllably oriented relative to a horizontal plane in accordance with any inclination in the polishing surface of the polishing cloth 2 which is in contact with the wafer, in order to maintain the surface of the wafer to be polished strictly parallel with the polishing surface, with the pressure applied to the surface of the wafer to be polished being controlled to be kept uniform across the entire area thereof. However, in some cases, such parallelism between the surface of the wafer 3 to be polished and the polishing surface of the turntable may not be required and, instead, the pressure supplied to the surface of the wafer to be polished may be controlled to be uniform by maintaining the surface of the wafer at a slight angle relative to the polishing surface.

According to this embodiment, a force for pressing the carrier body 9 against the polishing surface of the turntable 1 is obtained by transmitting the pressing force of the air cylinder 22 directly to the carrier 6. In contrast to the afore-mentioned prior art polishing apparatus which uses an electromagnetic bearing device to control an attitude of a wafer carrier, in accordance with this embodiment, the attitude controller 11 is used only to the control the tilt of the carrier. Consequently, the attitude controller 11 is able to be compact in size and simple in structure. To control the attitude of the carrier 6, the state of the polishing surface on the upper side of the turntable 1, including undulations or the like, are previously measured and input to the controller so that an optimum attitude or orientation of the carrier 6 is obtained on the basis of the data input in advance. Thus, optimum attitude of the carrier 6 is effected by the attitude controller 11 on the basis of the detection of the attitude by virtue of the displacement sensors 15.

Figure 7:
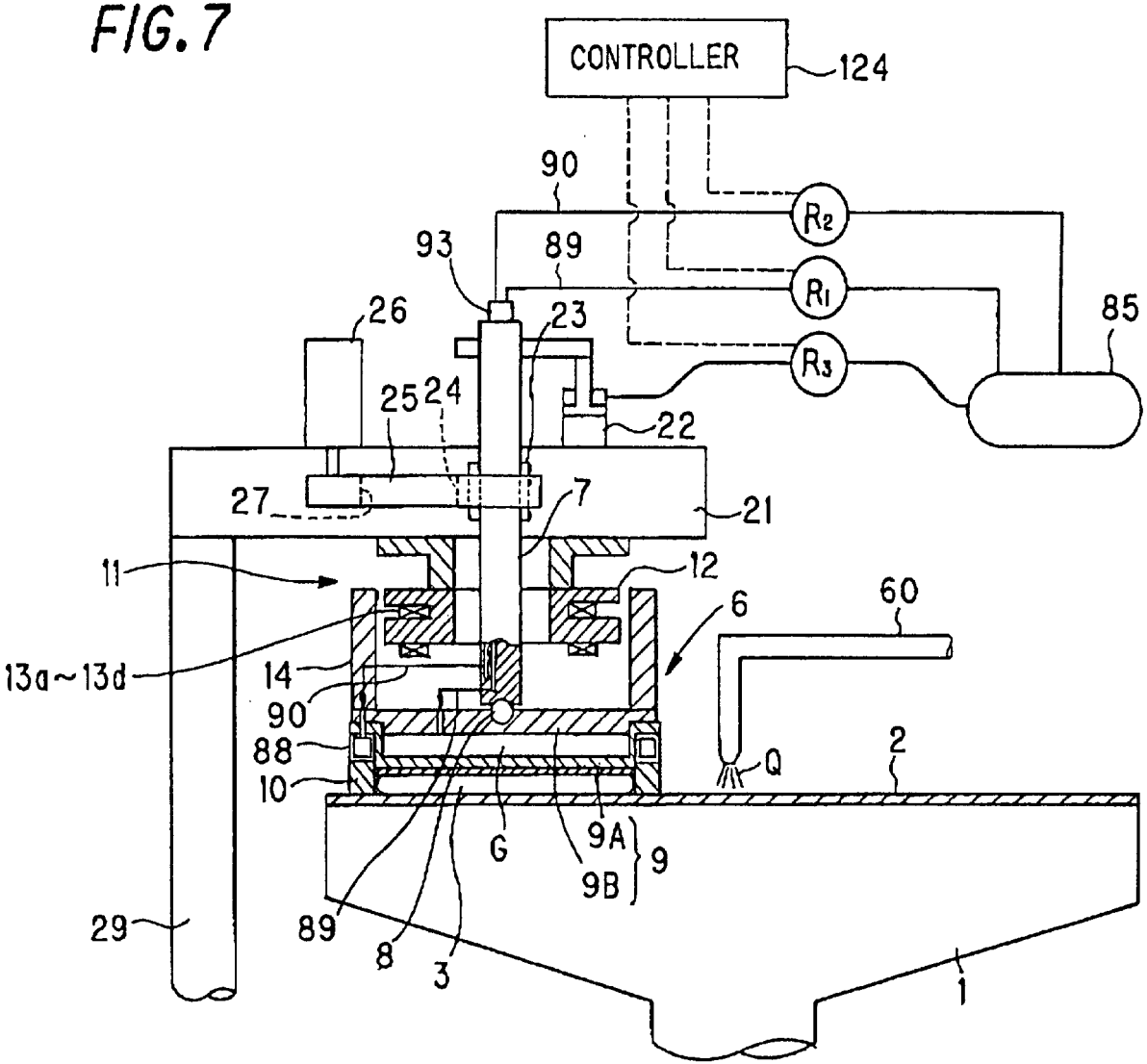
FIG. 7 is a vertical sectional view showing the general arrangement of a second embodiment of the polishing apparatus according to the present invention.
Figure 8:
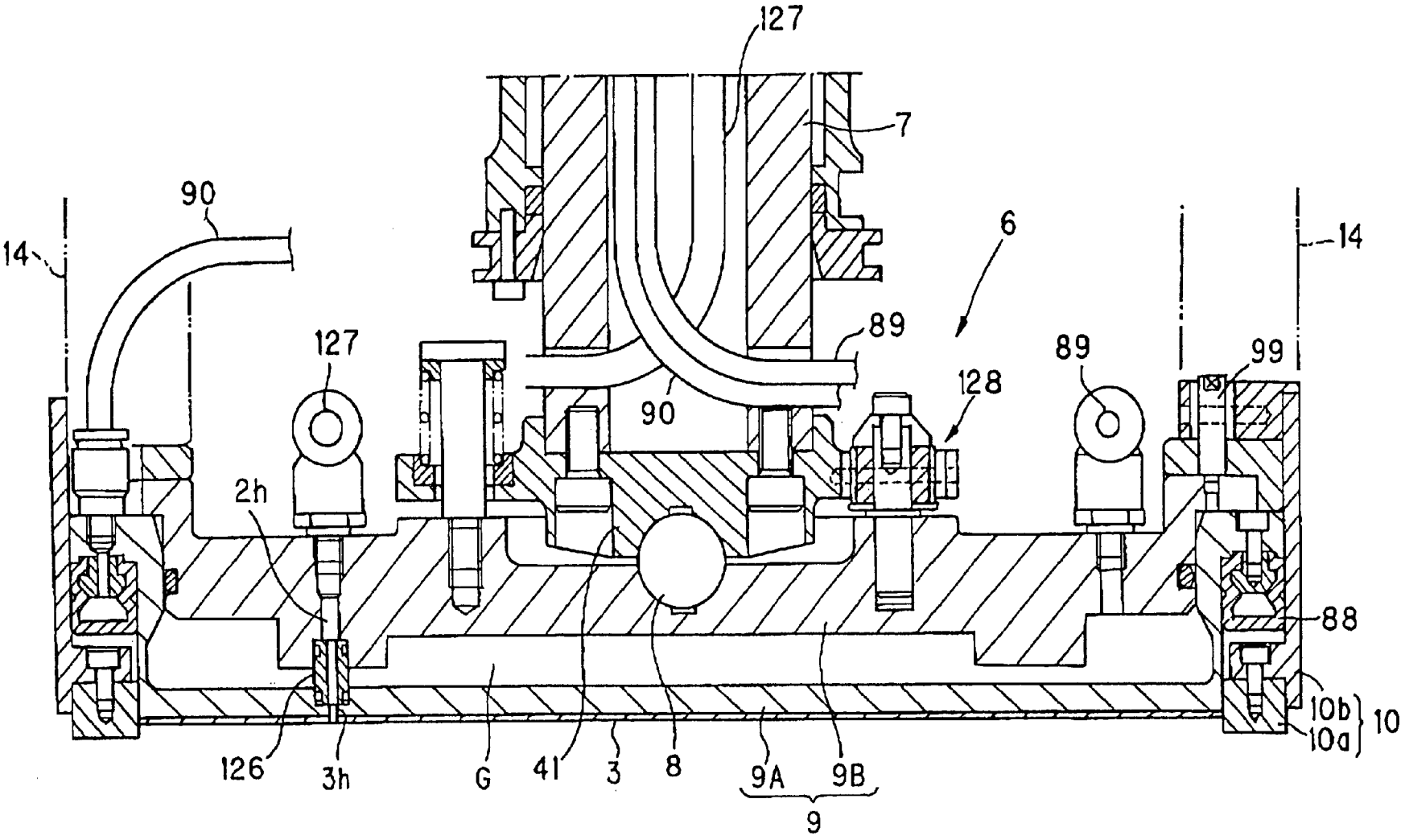
FIG. 8 is a fragmentary sectional view showing an essential part of the polishing apparatus of FIG. 7.

With reference to FIGS. 7 and 8, there is shown a second embodiment of a polishing apparatus with the attitude controller 11 as described above for controlling the attitude of the wafer carrier 6.

In this polishing apparatus, the holding plate 9A of the carrier body 9 is made of a flexible member and the gap G between the holding plate 9A and the mounting plate 9B is adapted to be supplied with a fluid pressure. Further, the retainer ring 10 is movable in a vertical direction relative to the wafer carrier 6. The retainer ring 10 is provided on its upper portion with a fluid bag 88 so that the retainer ring 10 is pressed against the polishing cloth 2 independently of the wafer carrier by introducing a fluid pressure into the bag 88.

The gap G is fluidly communicated with a fluid pressure source 85 through a tube 89 having a regulator $R_1$. The holding plate 9A is made thin as a whole so that, when the gap G is pressurized or depressurized by the fluid pressure introduced therein, the lower surface of the holding plate 9A is uniformly deformed as a whole.

As shown in FIG. 8, the retainer ring 10 includes a first retainer ring element 10*a* and a second retainer ring element 10*b* having a cross-section in the form of a reversed "L" and fixed on the first retainer element 10*a*. The second retainer ring element 10*b* is fixedly connected by a plurality of pins 99 to the mounting plate 9B of the wafer carrier body 9 at its upper end to enable the retainer ring 10 to rotate together with the wafer carrier 6. Further, the fluid bag 88 is annular and located between the retainer ring 10 and the wafer carrier 6 and fixed to the holding plate 9A. The bag 88 is fluidly connected to the fluid pressure source 85 through a tube 90 having a regulator $R_2$. As shown in FIG. 7, the wafer carrier actuating cylinder 22 is connected to the fluid pressure source 85 through a tube having a regulator $R_3$. The lower surface (wafer holding surface) of the holding plate 9A is controllably deformed in both a concave and convex manner in a vertical direction by controlling a pressure In the gap G.

The regulators $R_1$, $R_2$, $R_3$, are connected to a controller 124 to effect control thereof, whereby the pressures applied to the wafer 3 and the retainer ring 10 can be appropriately controlled. It is possible for the pressures under which the retainer ring 10 and the wafer 3 are pressed against the polishing cloth to be controlled independently from each other.

As shown in FIG. 8, the wafer carrier 6 is provided with an additional fluid line system including a through hole 2*h* formed in the mounting plate 98, a through hole 3*h* formed In the holding plate 9A, a connecting tube 126 connecting the through holes 2*h* and 3*h*, and a fitting 127 which is fluidly connected to a pressure source (not shown). The fluid line system enables the lower surface of the holding plate 9A to securely hold the wafer 3 under the influence of a vacuum applied to the upper surf ace of the wafer 3 through the fluid line system; for example, when the wafer is brought into contact with the polishing cloth 2 from the outside of the turntable. In a condition that the wafer held on the lower surface of the holding plate 9A is engaged with the polishing cloth 2 as shown in FIG. 7, if a positive pressure is applied to the upper surface of the wafer in place of the vacuum which was applied, a deformation in the wafer which may result from the influence of the vacuum can be rectified by the application of a positive pressure. Further, it is also possible for the fluid line system to remove the wafer from the holding plate 9A by applying a positive pressure to the upper surface of the wafer, for example, after polishing of the wafer.

The attitude controller 11 is substantially the same as that employed in the afore-mentioned embodiment in that the attitude controller 11 includes the annular armature 14 fixed to the mounting plate 9B and the electromagnetic core 12 fixed to the carrier head 21 and provided with the electromagnetic coils 13*a*–13*d*. The controller 11 controls the attitude of the wafer carrier 6 in the same manner as that described in connection with the first embodiment.

Figure 9:
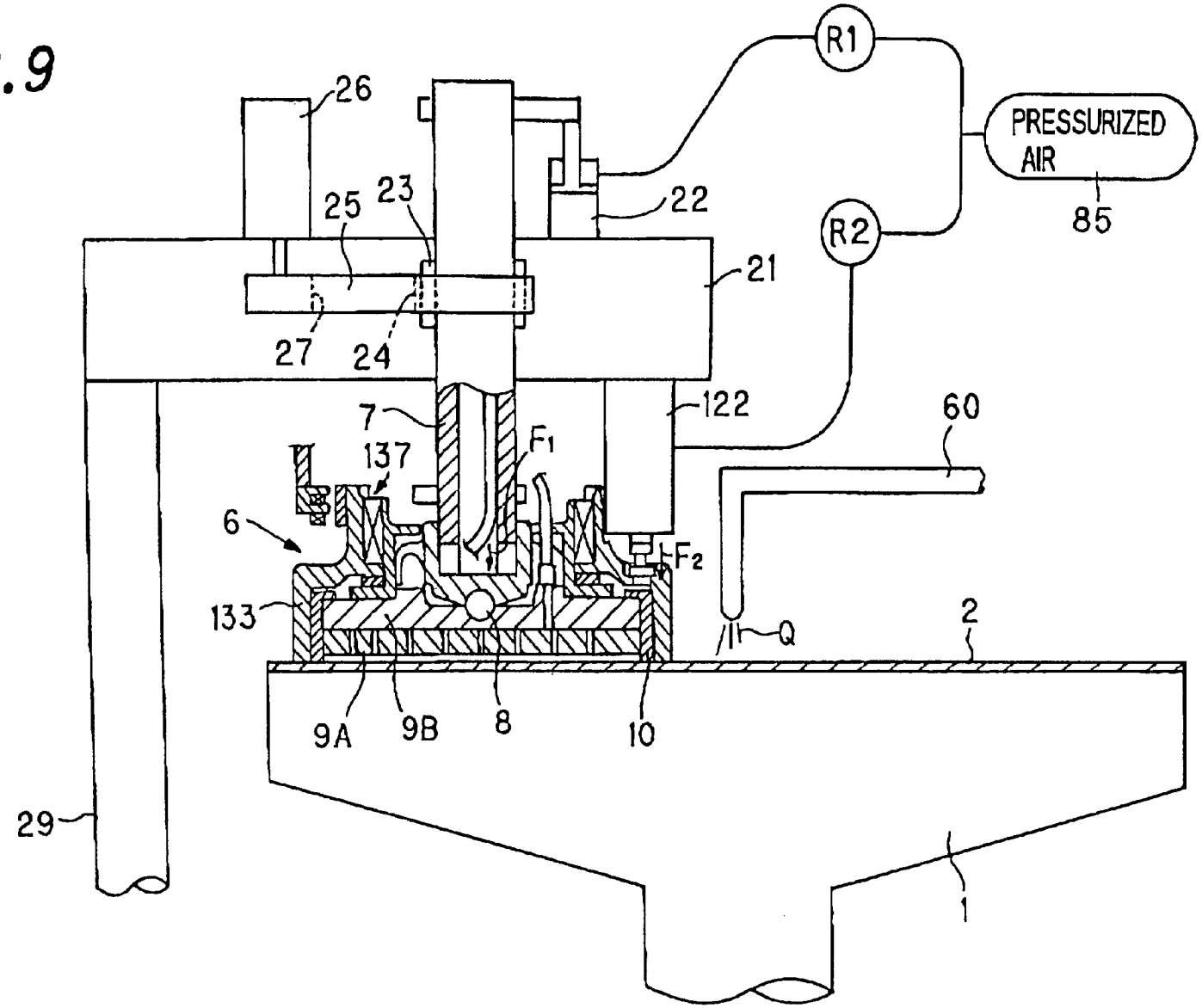
FIG. 9 is a vertical sectional view showing the general arrangement of a third embodiment of the polishing apparatus according to the present invention.
Figure 10:
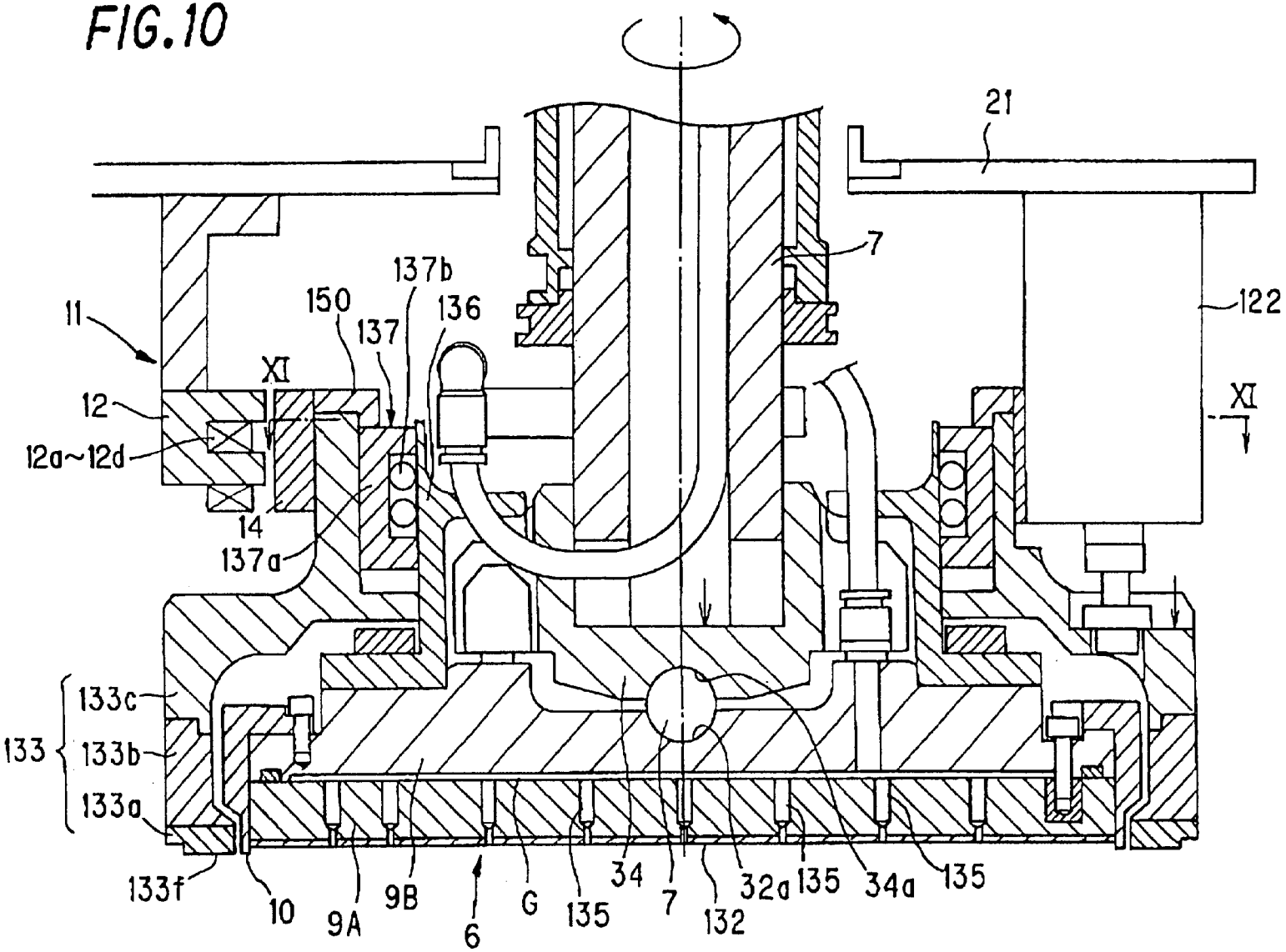
FIG. 10 is a fragmentary sectional view showing an essential part of the polishing apparatus of FIG. 9.
Figure 11:
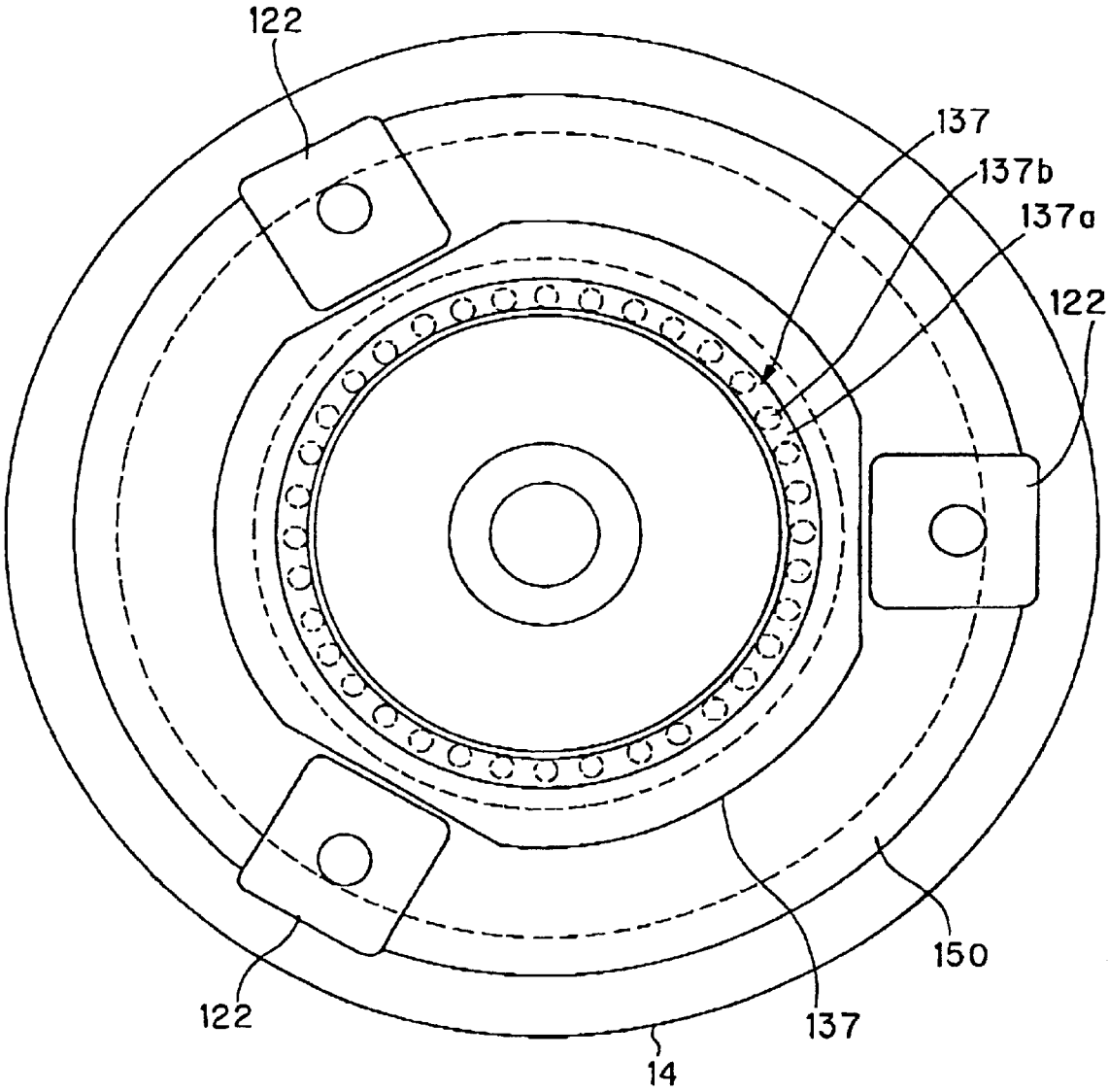
FIG. 11 is a sectional view taken along the line XI—XI in FIG. 10.

FIGS. 9, 10 and 11 show a third embodiment of a polishing apparatus of the present invention with the wafer carrier attitude controller 11 as described above.

This embodiment is distinguishable from the other embodiments in that the polishing apparatus of this embodiment additionally includes a pressing ring 133 provided radially outside the retainer ring 10. The pressing ring 133 includes a first ring element 133*a* made from alumina-ceramic and second and third ring elements 133*b* and 133*c* made from stainless steel. The first and second ring elements 133*a* and 133*b* are bonded to each other with an adhesive and the second and third ring elements 133*b* and 133*c* are connected by bolts (not shown). The lower surface of the first ring element 133*a* constitutes a pressing surface 133*f* for pressing the polishing cloth 2. The pressing element 133 is supported by an annular bearing 137 provided between the third ring element 133*c* and a cylindrical bearing raceway member 136 fixedly connected to the mounting plate 9B of the wafer carrier 6. The annular bearing 137 includes an annular bearing case 137*a* and a number of ball bearings 137*b* which are supported by a ball bearing retainer (not shown) in such a manner that the ball bearings 137*b* are, as shown in FIGS. 10 and 11, arranged along horizontal upper and lower circles in the bearing case 137*a*. The bearing case 137*a* is fastened to the third ring element 133*c* by a fastener 150 provided on the top end of the third ring element 133*c*. Between the pressing ring 133 and the carrier wafer head 21, there is provided three air cylinder devices 122 (FIG. 11). The bearing 137 makes it possible for the pressing ring 133 to be stationary while the wafer carrier 6 rotates inside the pressing ring 133. Accordingly, the pressing ring 133 is pressed by the air cylinder devices 122 against the polishing cloth 2 around the retainer ring 10 during polishing of the wafer 3 to optimize the polishing surface condition radially outside and adjacent to the periphery of the wafer 3.

The wafer carrier attitude controller 11 is substantially the same as that employed in the aforementioned embodiments. The annular armature 14 is fixed to the pressing ring 133 and the electromagnetic core 12 is fixed to the carrier head 21 and provided with the electromagnetic coils 13*a*–13*d*. The controller 11 controls the attitude of the pressing ring 133 (and thus the wafer carrier 6) In the same manner as that described in connection with the other embodiments.

Incidentally, the holding plate 9A of the wafer carrier 6 is formed with a plurality of through holes 135 connecting the gap G to the lower surface of the holding plate 9A. On the lower surface of the holding plate 9A, there is bonded a resilient pad 132 which includes a plurality of through holes corresponding to the through holes 135 formed in the holding plate 9A. As such, the fluid pressure in the gap G can be applied to the upper surface of a wafer placed on the lower surface of the resilient pad 132. Further, as shown in FIG. 10, the lower end portion of the retainer ring 10 is made thin in its radial direction so as to make it possible for the pressing ring 133 or the first ring element 133*a* thereof to be placed closer to the periphery of the wafer 3 held by the wafer carrier.

Figure 12:
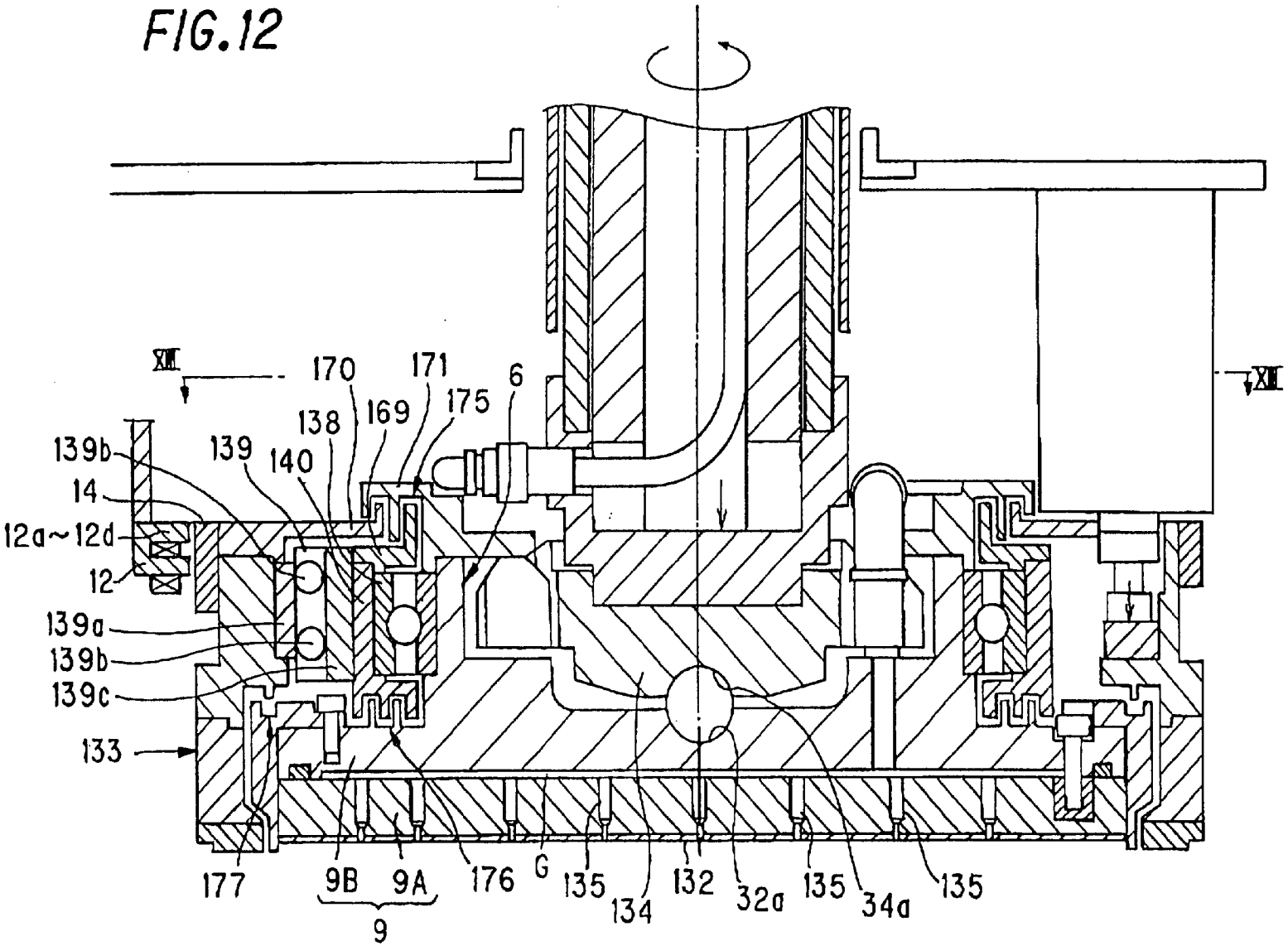
FIG. 12 is a vertical sectional view showing the general arrangement of a fourth embodiment of the polishing apparatus according to the present invention.
Figure 13:
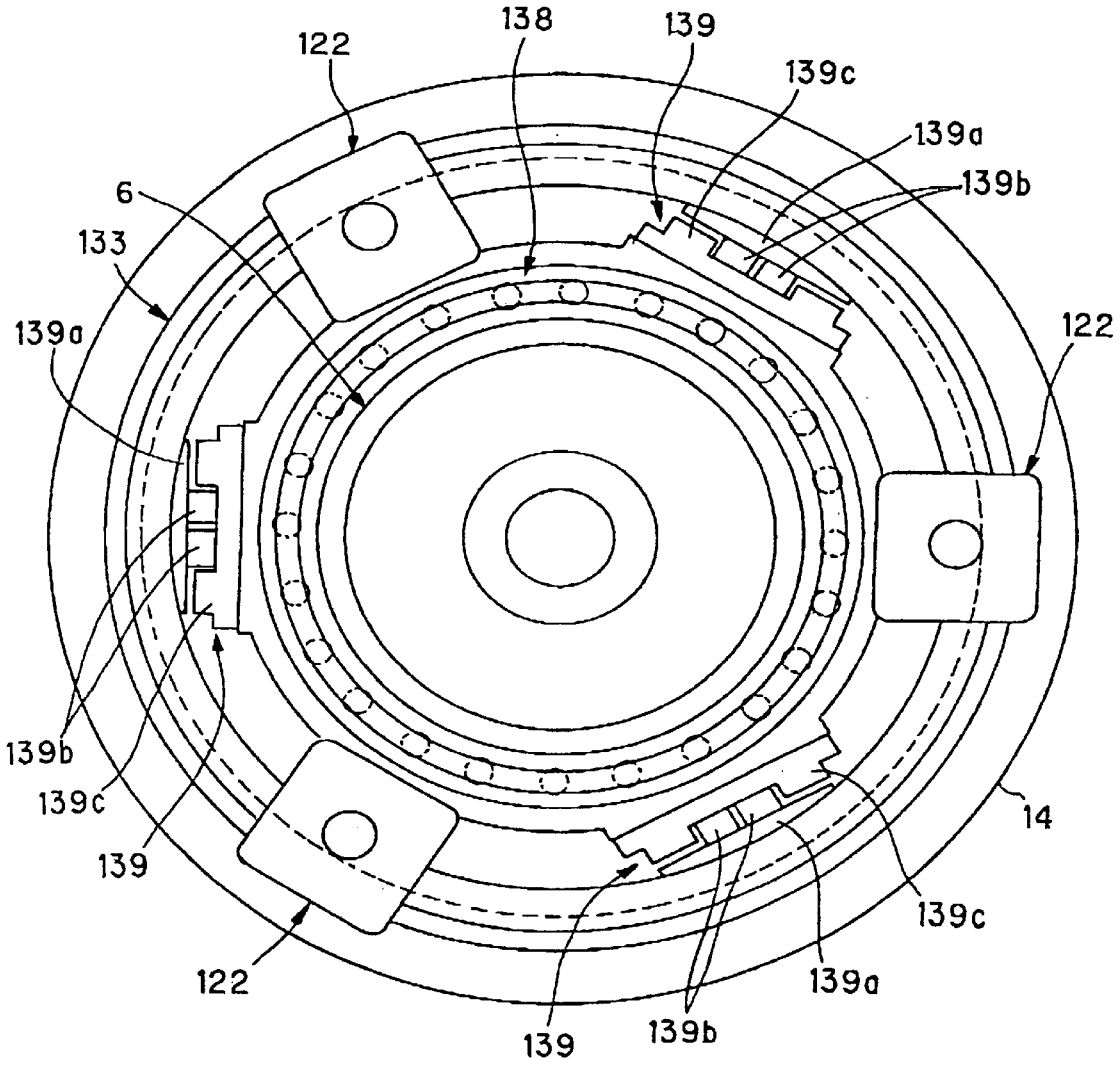
FIG. 13 is a sectional view taken along the line XIII—XIII in FIG. 12.

With reference to FIGS. 12 and 13, there is shown a fourth embodiment of a polishing apparatus with the attitude controller 11 as described above in connection with the other embodiments.

This polishing apparatus is substantially the same as that shown in FIGS. 9, 10 and 11 except for the bearing supporting the pressing ring 133 on the wafer carrier 6. In this polishing apparatus, the bearing consists of two kinds of bearings 138 and 139. The bearing 138 is a conventional radial bearing for allowing the wafer carrier to rotate relative to the pressing ring 133 which is kept stationary, while maintaining the positional relationship in the vertical direction between the wafer carrier 6 and the pressing ring 133. The bearings 139 are, as shown in FIG. 13, provided around the wafer carrier 6 at an angular interval of 120° and allow relative movement between the pressing ring 133 and the wafer carrier 6 in a vertical direction. The bearing 139 includes an outside raceway member 139*a*, cylindrical bearings 139*b* which are arranged in two rows and two columns and an inside raceway member 139*c*. The bearing 138 is provided between the inside raceway member 139*c* and the mounting plate 9B of the wafer carrier 6. The above-described bearing construction enables the bearings to be used for a longer period than that employed in the embodiment shown in FIGS. 9–11. It should be noted that in this embodiment, labyrinth seals 175, 176, 177 are employed for the bearings 138 and 139 to prevent foreign particles from entering into the bearings.

With reference to FIGS. 14–18, there is shown a polishing apparatus in accordance with a fifth embodiment of the present invention.

This embodiment differs from the other embodiments in that the wafer carrier 6 is not provided with an attitude controller as explained above in connection with the other embodiments and, instead, a similar attitude controller 111 is provided for the turntable 1.

Figure 14:
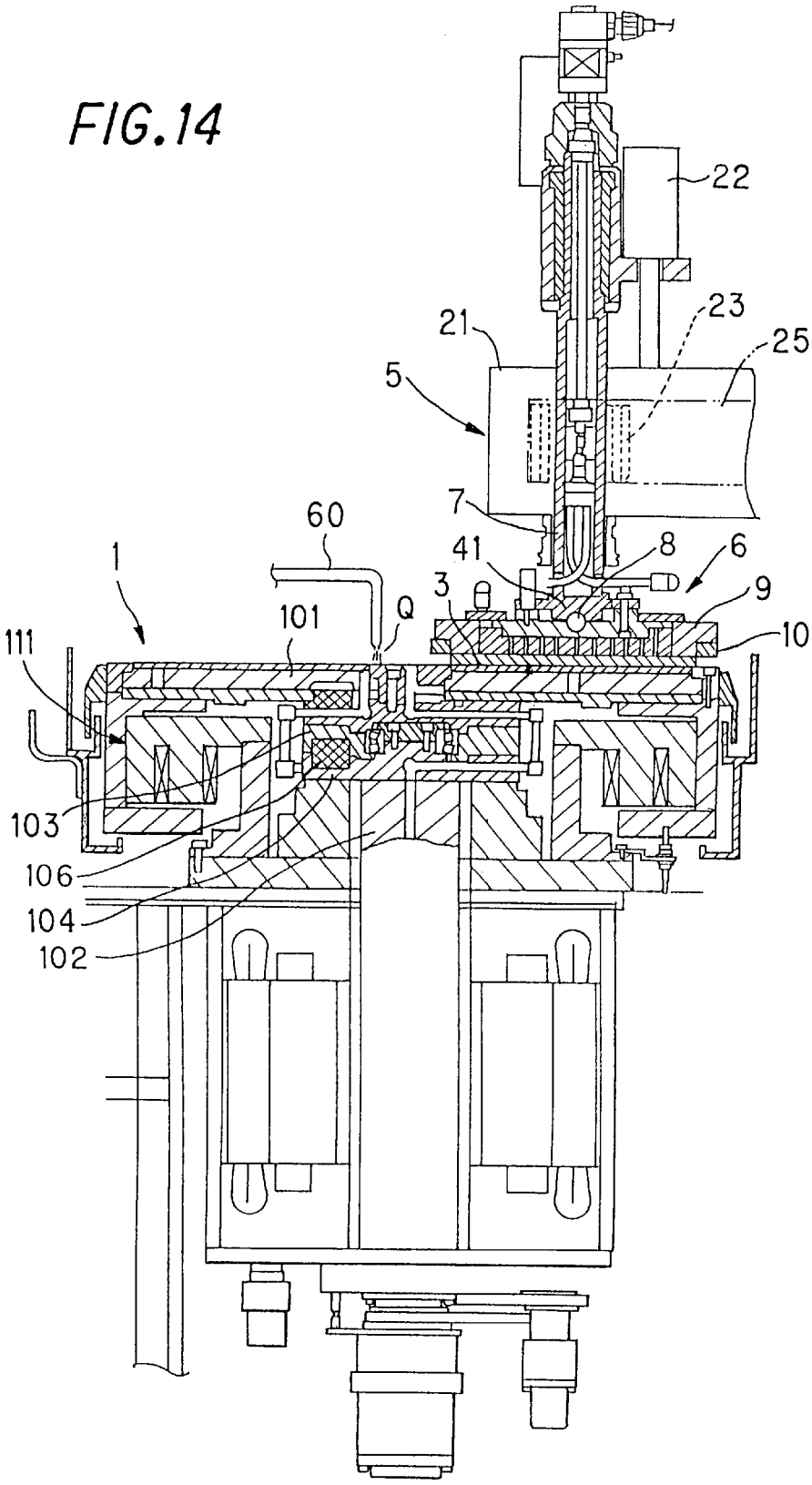
FIG. 14 is a vertical sectional view showing the general arrangement of a fifth embodiment of the polishing apparatus according to the present invention.
Figure 15:
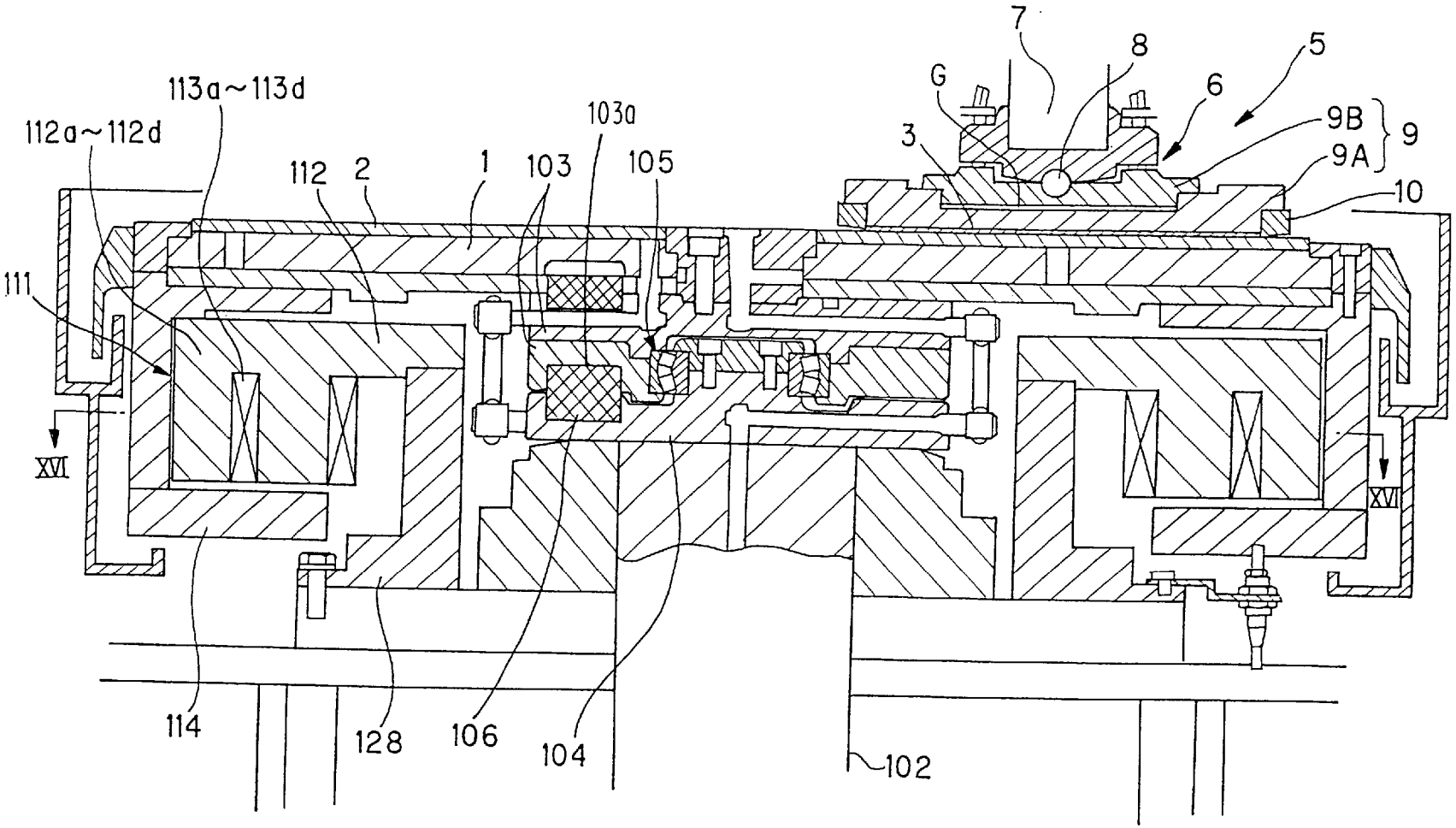
FIG. 15 is a fragmentary sectional view showing an essential part of the polishing apparatus of FIG. 14.

As shown in FIGS. 14 and 15, the turntable 1 is connected to a rotating shaft 102 of a motor (not shown) through a universal joint including upper and lower coupling members 103 and 104. The lower coupling member 104 is secured to the upper end of the rotating shaft 102 of the motor. The upper coupling member 103 is secured to the lower surface of the turntable 1. A self-aligning roller bearing 105 is disposed between the lower coupling member 104 and the upper coupling member 103 to allow the turntable 1 and the upper coupling member 103 to tilt in any direction desired with respect to the lower coupling member 104 about the self-aligning roller bearing 105 as the center of rotation. The universal joint further includes a short column-shaped pin 106 which is fixed to the coupling member 104 and is engaged with an engagement hole 103*a* formed in the upper coupling member 103 to transmit rotation from the shaft 102 to the turntable 1. It should be noted that a predetermined clearance is formed between the engagement hole 103*a* and the pin 106 so that tilting of the turntable 1 is allowed.

In this embodiment, the turntable attitude controller 111 for controlling the attitude of the turntable 1 includes an electromagnetic core 112 secured to a frame 128. The electromagnetic core 112 is provided with four magnetic poles 112*a*, 112*b*, 112*c* and 112*d*. Four electromagnetic coils 113*a*, 113*b*, 113*c* and 113*d* are wound on the magnetic poles 112*a* to 112*d*, respectively. The attitude controller 111 further includes an annular disk-shaped armature 114 facing the magnetic poles 112*a* to 112*d* across a gap. The armature 114 is secured to the turntable 1.

Figure 16:
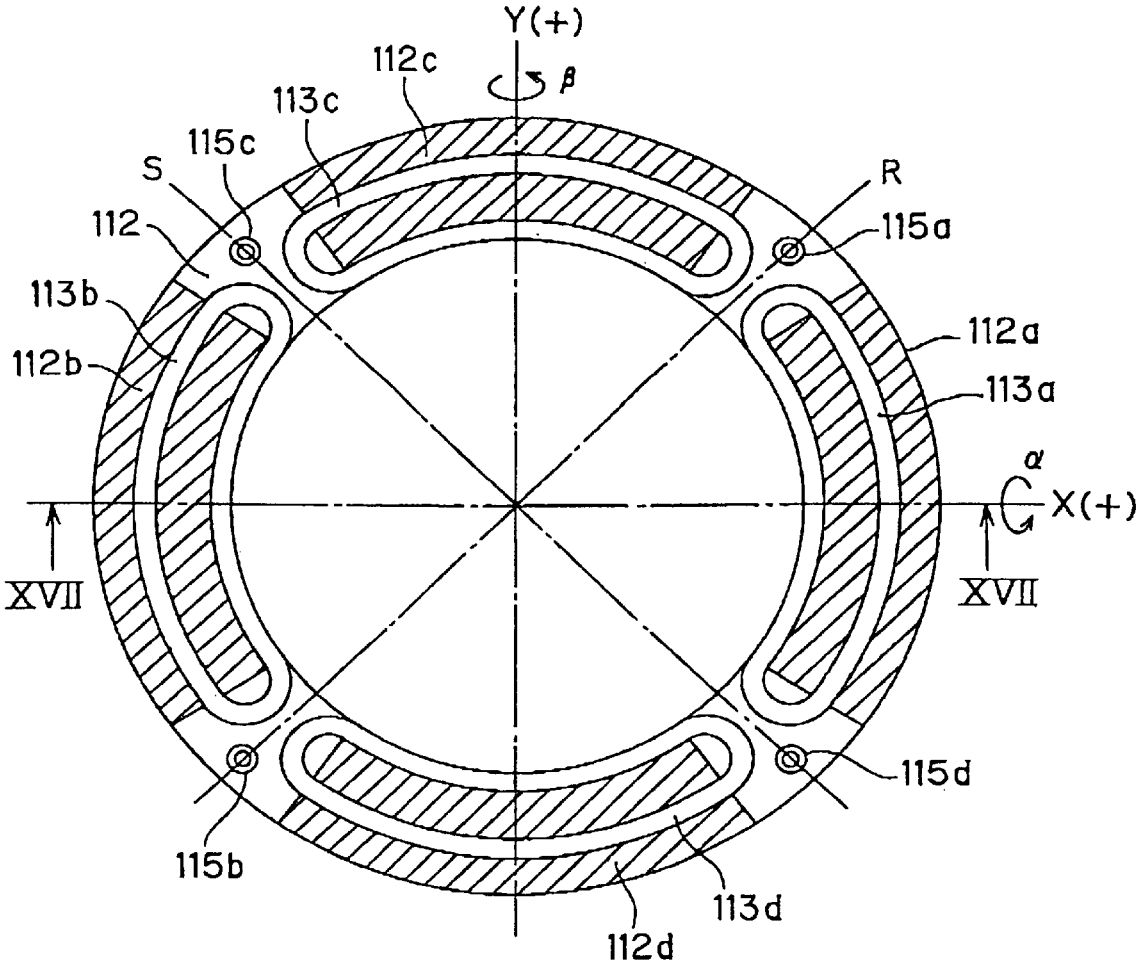
FIG. 16 is a sectional view taken along the line XVI—XVI In FIG. 15.
Figure 17:
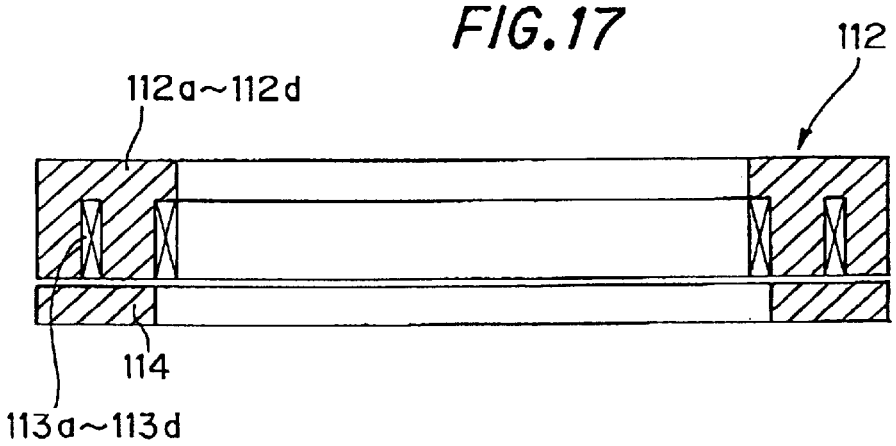
FIG. 17 is a sectional view taken along the line XVII—XVII in FIG. 16.

As shown in FIGS. 15 and 17, the magnetic poles 112*a* to 112*d* each have an inverted U-shaped sectional configuration. The inner portions of the inverted U-shaped magnetic poles 112*a* to 112*d* are wound with the electromagnetic coils 113*a* to 113*d*, respectively. The magnetic poles 112*a* to 112*d* and the armature 114 are formed from a magnetic material, e.g. a permalloy. As shown in FIG. 16, the electromagnetic coil 113*a* is placed at a position in positive alignment with the X-axis. The electromagnetic coil 113*b* is placed at a position in negative alignment with the X-axis. The electromagnetic coil 113*c* is placed at a position in positive alignment with the Y-axis. The electromagnetic coil 113*d* is placed at a position in negative alignment with the Y-axis. Four displacement sensors 115*a*, 115*b*, 115*c* and 115*d* are placed on two axes R and S tilted at 45 degrees with respect to the X- and Y-axes.

Figure 18:
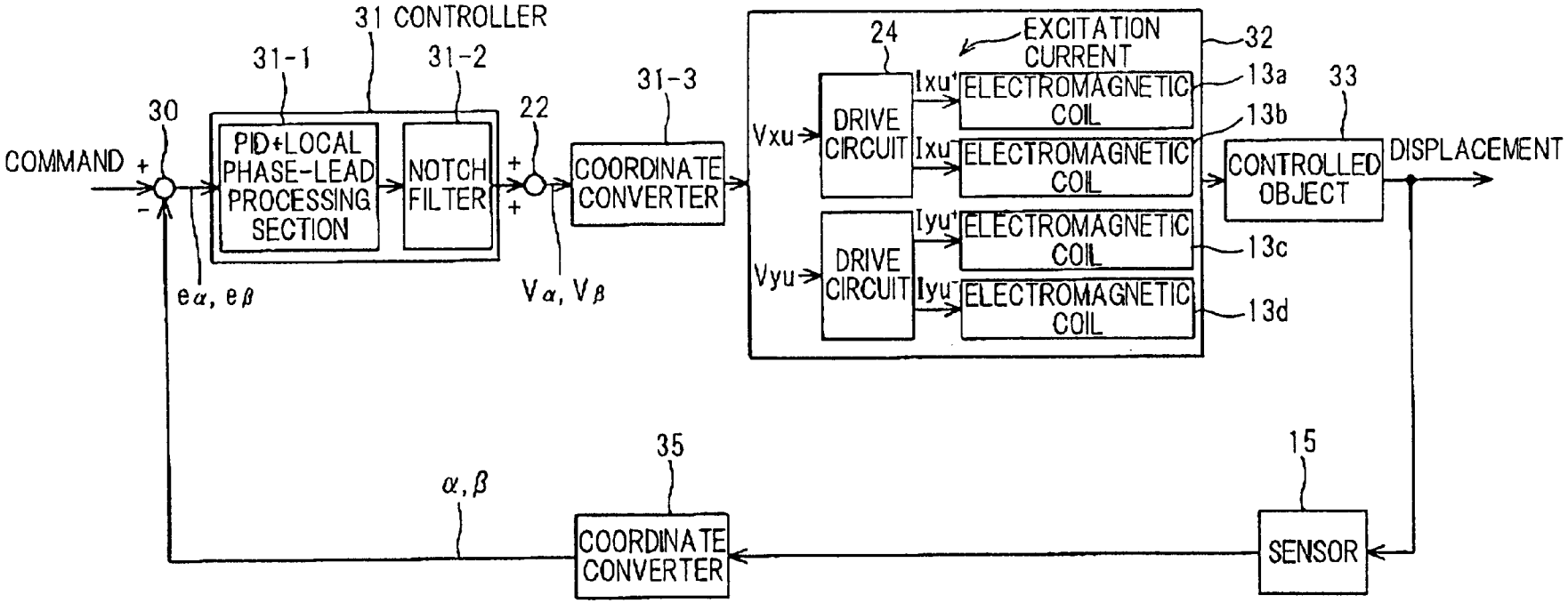
FIG. 18 is a block diagram showing the functional arrangement of a control part for controlling an attitude controller for a turntable.

FIG. 18 is a block diagram showing the functional arrangement of a control part for controlling the attitude controller 111. As shown in the figure, the control part is substantially the same as that of the control part shown in FIG. 5 in both arrangement and function.

Figure 19:
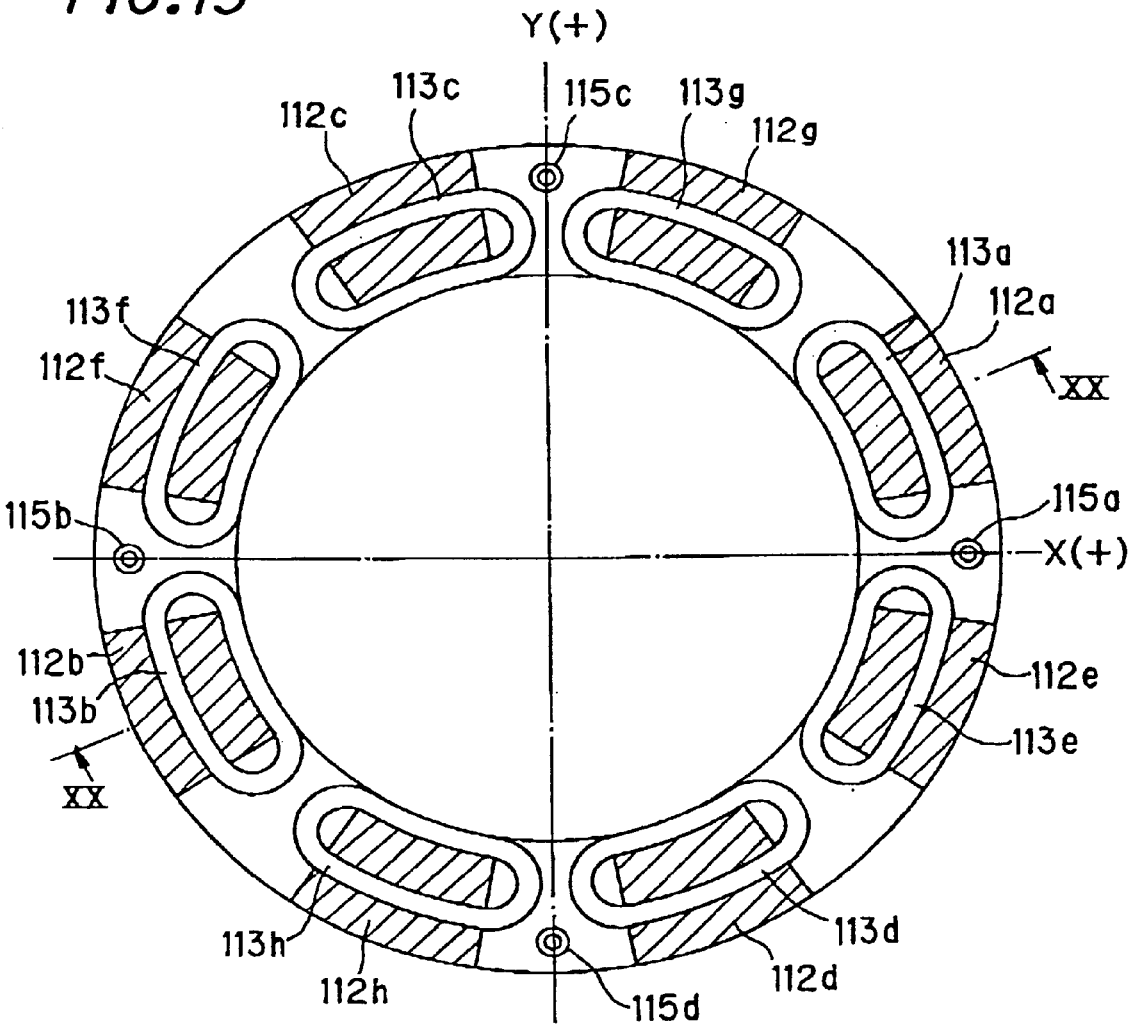
FIG. 19 is a view similar to FIG. 16 but showing an electromagnetic device including eight electromagnetic coils.
Figure 20:
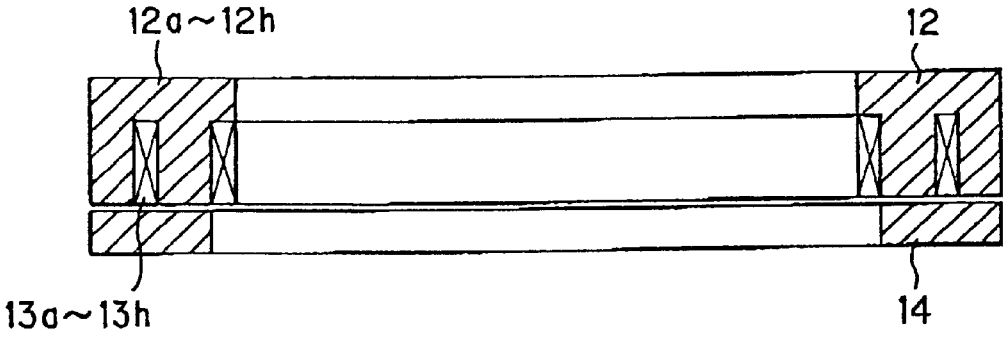
FIG. 20 is a sectional view taken along the line XX—XX in FIG. 19.

FIGS. 19 and 20 show another embodiment of the electromagnetic core 112 which is provided with eight electromagnetic coils 112*a*–112*h* arranged at an equal angular interval of 45° and gap sensors 115*a*–115*d* at an equal angular interval of 90°.

Figure 21:
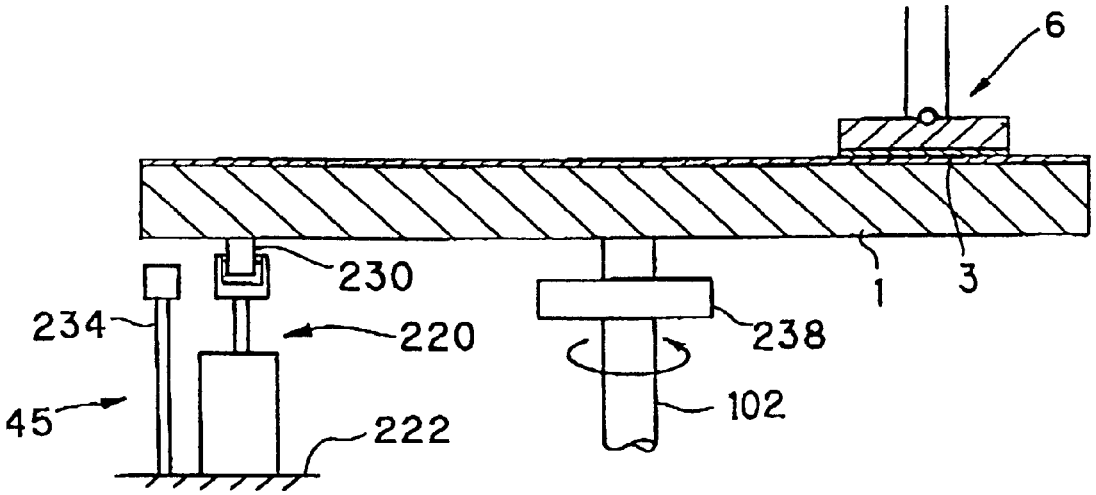
FIG. 21 is a vertical sectional view showing the general arrangement of a sixth embodiment of the polishing apparatus according to the present invention.
Figure 22:
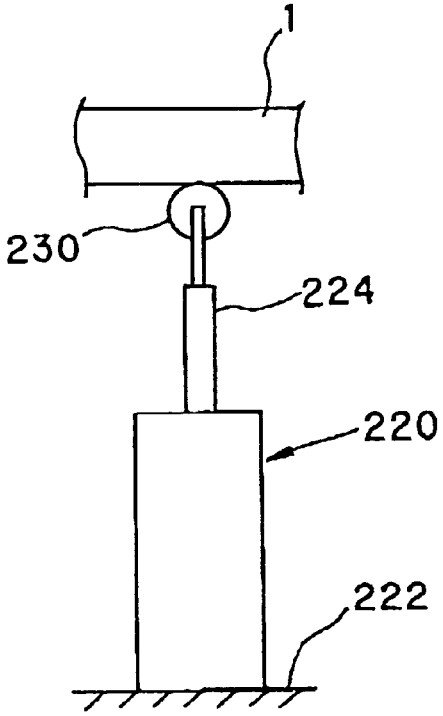
FIG. 22 is a side elevation view of a cylinder device employed in the polishing apparatus of FIG. 21.

FIGS. 21 and 22 show a sixth embodiment or a variation of the fifth embodiment shown in FIGS. 14 and 15. In this embodiment, in place of the magnetic attitude controller 111, another type of an attitude controller 111 is used. The controller includes a plurality of air cylinder devices 220 (only one is shown) arranged around the turntable drive shaft 102 at an equal angular interval under the periphery of the turntable 1. The cylinder device 220 includes a cylinder body fixed to the stationary frame 222 and a rod extending from the cylinder body upward. The rod is provided on its upper end with a roller 230 which rotatably engages with the lower surface of the turntable 1. The controller further includes a gap sensor 234 adapted to sense a gap between the sensor 234 and the lower surface of the turntable 1. On the basis of values of the gaps sensed by the sensors 234, the rods of the cylinder devices are extended or retracted as to control the attitude of the turntable. For the sake of simplicity, explanation of the control part of the controller is omitted, as it is substantially the same as that of the controllers for the wafer carrier and turntable explained in connection with the other embodiments. In FIG. 21, reference numeral 238 designates a universal joint for connecting the drive shaft 102 and the turntable 1.

Figure 23:
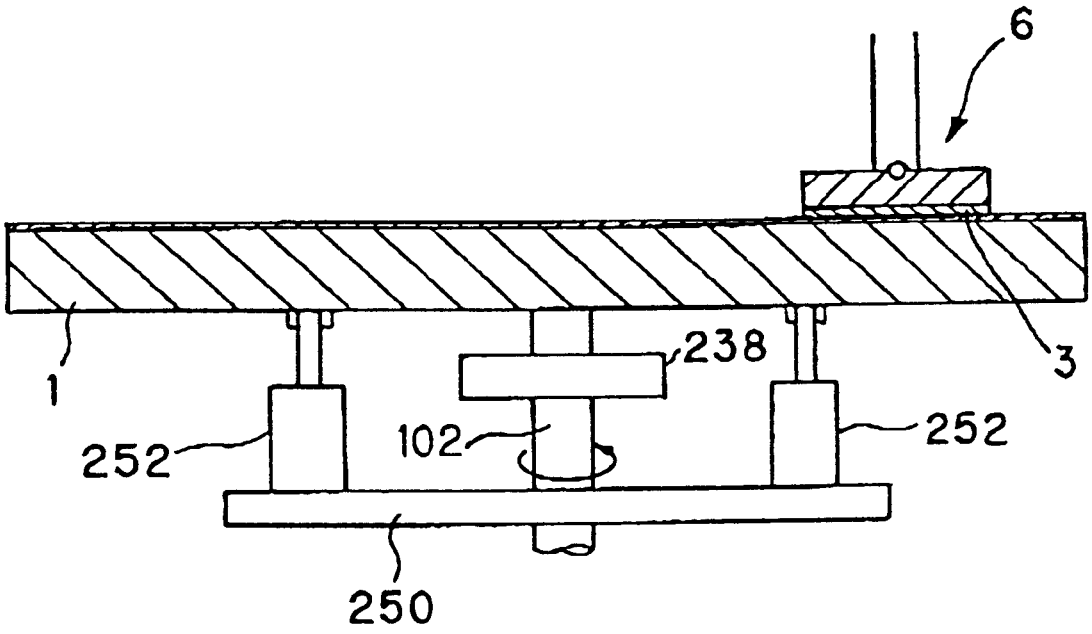
FIG. 23 is a vertical sectional view showing the general arrangement of a seventh embodiment of the polishing apparatus according to the present invention.

FIG. 23 shows a seventh embodiment or a variation of the fifth embodiment. In this embodiment, the turntable drive shaft 102 has a disc 250 fixed thereto and a plurality of cylinder devices 252 are fixedly provided between the disc 250 and the turntable 1. Gap sensors (not shown) similar to those 234 employed in the sixth embodiment are mounted on the disc 250. The attitude of the turntable 1 is effected in the same manner as that in the sixth embodiment.

Figure 24:
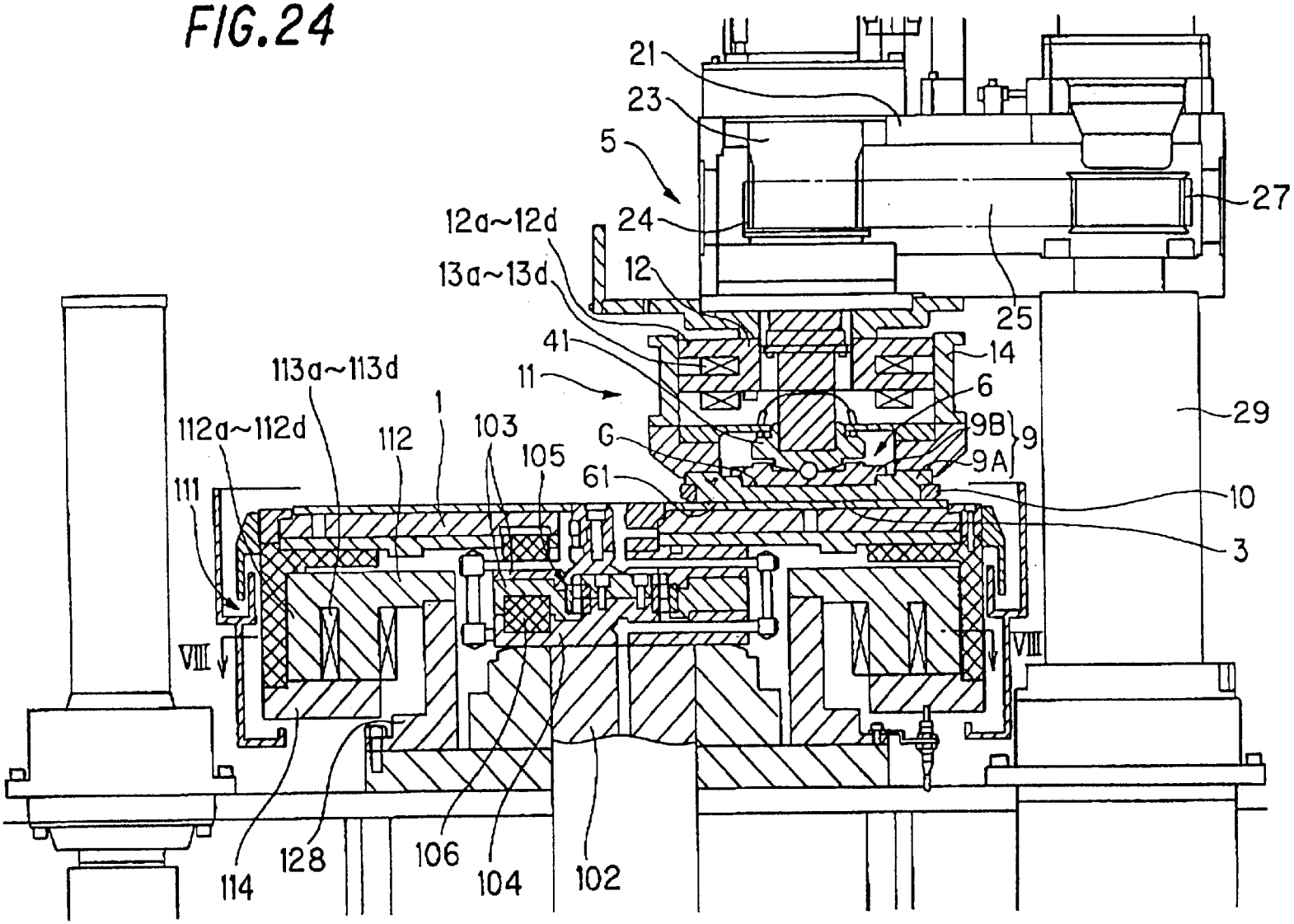
FIG. 24 is a fragmentary sectional view showing an essential part of a polishing apparatus according to a eighth embodiment of the present invention.
Figure 25:
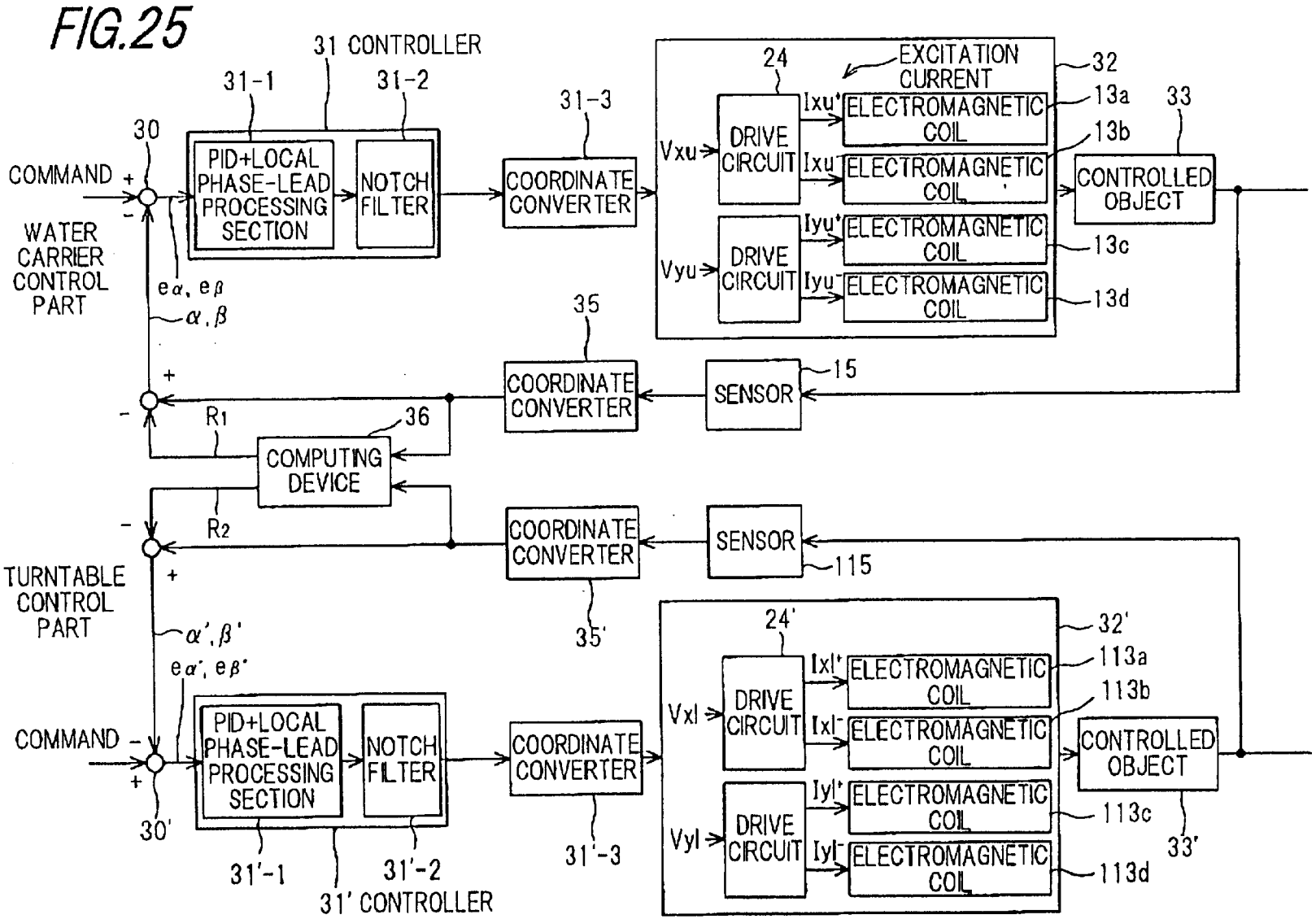
FIG. 25 is a block diagram showing the functional arrangement of control parts for controlling attitude controllers for a turntable and a wafer carrier.
Figure 26:
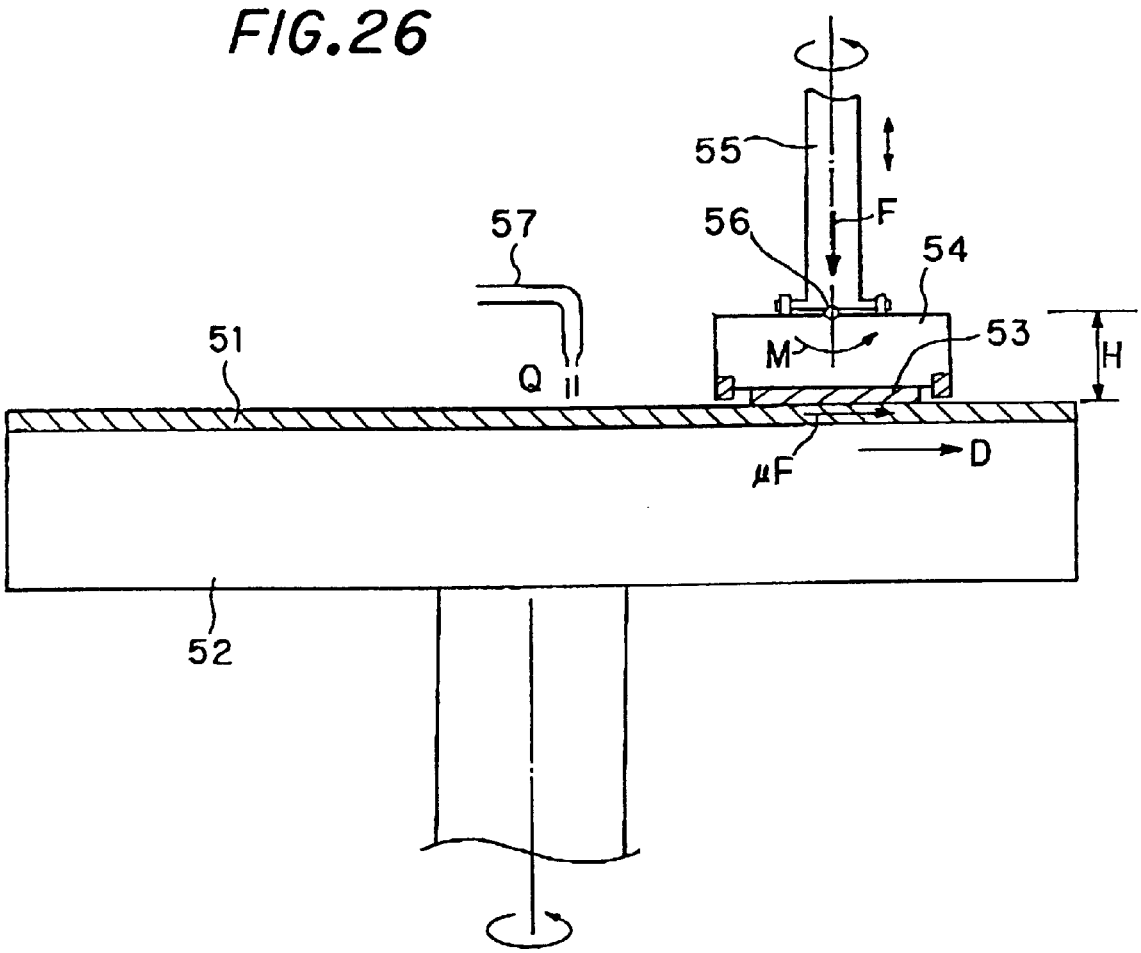
FIG. 26 is a schematical side elevation view of a conventional polishing apparatus.

FIGS. 24 and 25 show a eighth embodiment of the present invention or a combination of the embodiment shown in FIGS. 1–6 and the embodiment shown in FIGS. 14–18. For the purpose of simplicity, detailed explanation thereabout is omitted. FIG. 25 is a block diagram showing the functional arrangement of a combination of a control part for controlling the turntable attitude controller 111 and a control part for controlling the wafer carrier attitude controller 11. As shown in the figure, the turntable control part and the wafer carrier control part each have an arrangement similar to that of the control part shown in FIGS. 5 and 18. Elements of the wafer carrier control part which are the same as those in FIG. 5 are designated by the same reference numerals as those of the latter and elements of the turntable control part which are the same as those in FIG. 18 are designated by the same reference numerals with primes "'" as those of the latter. The arrangement shown in FIG. 25 is additionally provided with a computing device 36 for precisely detecting relative positions of the carrier and the turntable on the basis of signals input thereto from the carrier control part and the turntable control part Specifically, the computing device 36 computes relative errors from information concerning the tilt of the carrier and information concerning the tilt of the turntable to generate rectified displacement values $\alpha$, $\beta$, $\alpha'$ and $\beta'$, thereby allowing control to be effected with a high degree of accuracy. Normally, the degree of accuracy can be increased by correcting the desired position of the carrier with reference to the tilt of the turntable. Thus, the feedback R2 to the turntable may be omitted. Further, the computing device may be omitted.

As has been stated above, according to the present invention, the attitude of the wafer carrier and/or the turntable is controlled so that a polishing operation can be carried out while maintaining a distribution of pressure under which a wafer is pressed against the polishing cloth uniform across the entire wafer surface engaged with the polishing cloth. Accordingly, it is possible to obtain a polished surface having a high degree of flatness.

It should be noted that the present invention is not necessarily limited to the foregoing embodiments but can be modified in a variety of ways without departing from the gist of the present Invention.

What is claimed is:

1. A polishing apparatus comprising:

a polishing surface that is to come into sliding contact with an object to be polished;

a support to tiltably support said polishing surface; and an attitude controller to control an attitude or an orientation of said polishing surface.

2. The polishing apparatus according to claim 1, further comprising a turntable having said polishing surface thereon, wherein said support is to tiltably support said polishing surface by tiltably supporting said turntable, and wherein said attitude controller is to control an attitude or an orientation of said polishing surface by controlling an attitude or an orientation of said turntable.

3. The polishing apparatus according to claim 2, wherein said attitude controller is for controlling an attitude or an orientation of said turntable by controlling an angle of tilting of said turntable relative to said support via an electromagnetic force.

4. The polishing apparatus according to claim 3, further comprising a stationary frame, and wherein said attitude controller includes:

an electromagnetic device fixedly provided on said stationary frame; and an armature fixedly provided on said turntable and adapted to be moved by an electromagnetic force that is generated by said electromagnetic device.

5. The polishing apparatus according to claim 3, further comprising a stationary frame, and wherein said attitude controller includes a cylinder device fixed to said stationary frame and engaged with a lower surface of said turntable, whereby said attitude controller is to control the attitude or the orientation of said turntable via extension and retraction of said cylinder device.

6. A polishing apparatus comprising:

a polishing surface;

a carrier to hold an article to be polished in sliding contact with said polishing surface;

a drive shaft connected to said carrier via a universal joint that allows said carrier to tilt relative to said drive shaft, with said drive shaft to drivingly rotate said carrier and press said carrier towards said polishing surface while the article is in contact with said polishing surface; and an attitude controller to control an attitude or an orientation of said carrier by causing said carrier to tilt relative to said drive shaft.

7. The polishing apparatus according to claim 6, further comprising a turntable having said polishing surface thereon, wherein said drive shaft is to press said carrier towards said polishing surface while the article is in contact with said polishing surface by pressing said carrier towards said turntable.

8. The polishing apparatus according to claim 7, further comprising a frame to support said drive shaft such that said drive shaft can rotate about its axis, and wherein said attitude controller includes:

an electromagnetic device fixedly provided on said frame; and an armature fixedly provided on said carrier and adapted to be moved by an electromagnetic force that is generated by said electromagnetic device.

9. The polishing apparatus according to claim 8, wherein said attitude controller further includes a sensor to sense an attitude or an orientation of said carrier, whereby said attitude controller is to control the attitude or the orientation of said carrier in response to the attitude or the orientation as sensed by said sensor.

10. The polishing apparatus according to claim 7, further comprising:

a pressing device positioned radially outside of said carrier and axially movable independently of said carrier;

an urging device to urge said pressing device; and a bearing to support said pressing device on said carrier, whereby said carrier is allowed to rotate relative to said pressing device.

11. The polishing apparatus according to claim 7, wherein said carrier includes:

a mounting member connected to said drive shaft; and an article holding member, with a gap between said mounting member and said article holding member, wherein said article holding member is flexible and has a lower surface to hold an article to be polished, whereby said article holding member can be deformed in an axial direction by controlling a pressure in said gap such that said lower surface exhibits either a concave configuration or a convex configuration.

12. The polishing apparatus according to claim 11, wherein said carrier further includes a retainer ring positioned about an outer periphery of said article holding member to confine the article held on said lower surface of said article holding member, with said retainer ring being axially movable relative to said article holding member, and wherein said carrier further includes a pressing device to press said retainer ring axially against said polishing surface.

13. A polishing apparatus comprising:

a polishing surface;

a support to tiltably support said polishing surface;

a first attitude controller to control an attitude or an orientation of said polishing surface;

a carrier to hold an article to be polished in sliding contact with said polishing surface;

a pressing member connected to said carrier and adapted to press said carrier towards said polishing surface while the article is in contact with said polishing surface; and a second attitude controller to control an attitude or an orientation of said carrier.

14. The polishing apparatus according to claim 13, further comprising a turntable having said polishing surface thereon, wherein said support is to tiltably support said polishing surface by tiltably supporting said turntable, wherein said first attitude controller is to control an attitude or an orientation of said polishing surface by controlling an attitude or an orientation of said turntable, and wherein said pressing member is to press said carrier towards said polishing surface while the article is in contact with said polishing surface by pressing said carrier towards said turntable.

15. The polishing apparatus according to claim 14, wherein said first attitude controller is for controlling an attitude or an orientation of said turntable by controlling an angle of tilting of said turntable relative to said support via an electromagnetic force.

16. The polishing apparatus according to claim 15, further comprising a stationary frame, and wherein said first attitude controller includes:

an electromagnetic device fixedly provided on said stationary frame; and an armature fixedly provided on said turntable and adapted to be moved by an electromagnetic force that is generated by said electromagnetic device.

17. The polishing apparatus according to claim 15, further comprising a stationary frame, and wherein said first attitude controller includes a cylinder device fixed to said stationary frame and engaged with a lower surface of said turntable, whereby said first attitude controller is to control the attitude or the orientation of said turntable via extension and retraction of said cylinder device.

18. The polishing apparatus according to claim 17, wherein said pressing member comprises a drive shaft connected to said carrier via a universal joint that allows said carrier to tilt relative to said drive shaft, with said drive shaft to drivingly rotate said carrier.

19. The polishing apparatus according to claim 18, further comprising a frame to support said drive shaft such that said drive shaft can rotate about its axis, and wherein said second attitude controller includes:

an electromagnetic device fixedly provided on said frame; and an armature fixedly provided on said carrier and adapted to be moved by an electromagnetic force that is generated by said electromagnetic device.

20. The polishing apparatus according to claim 19, wherein said second attitude controller further includes a sensor to sense an attitude or an orientation of said carrier, whereby said second attitude controller is to control the attitude or the orientation of said carrier in response to the attitude or the orientation as sensed by said sensor.

21. The polishing apparatus according to claim 18, further comprising:

a pressing device positioned radially outside of said carrier and axially movable independently of said carrier;

an urging device to urge said pressing device; and a bearing to support said pressing device on said carrier, whereby said carrier is allowed to rotate relative to said pressing device.

22. The polishing apparatus according to claim 18, wherein said carrier includes:

a mounting member connected to said drive shaft; and an article holding member, with a gap between said mounting, member and said article holding member, wherein said article holding member is flexible and has a lower surface to hold an article to be polished, whereby said article holding member can be deformed in an axial direction by controlling a pressure in said gap such that said lower surface exhibits either a concave configuration or a convex configuration.

23. The polishing apparatus according to claim 22, wherein said carrier further includes a retainer ring positioned about an outer periphery of said article holding member to confine the article held on said lower surface of said article holding member, with said retainer ring being axially movable relative to said article holding member, and wherein said carrier further includes a pressing device to press said retainer ring axially against said polishing surface.

24. The polishing apparatus according to claim 17, further comprising:

a pressing device positioned radially outside of said carrier and axially movable independently of said carrier;

an urging device to urge said pressing device; and a bearing to support said pressing device on said carrier, whereby said carrier is allowed to rotate relative to said pressing device.

25. The polishing apparatus according to claim 17, wherein said carrier includes:

a mounting member connected to said pressing member; and an article holding member, with a gap between said mounting member and said article holding member, wherein said article holding member is flexible and has a lower surface to hold an article to be polished, whereby said article holding member can be deformed in an axial direction by controlling a pressure in said gap such that said lower surface exhibits either a concave configuration or a convex configuration.

26. The polishing apparatus according to claim 25, wherein said carrier further includes a retainer ring positioned about an outer periphery of said article holding member to confine the article held on said lower surface of said article holding member, with said retainer ring being axially movable relative to said article holding member, and wherein said carrier further includes a pressing device to press said retainer ring axially against said polishing surface.

* * * * *